US011403916B1

(12) United States Patent
Morris

(10) Patent No.: US 11,403,916 B1
(45) Date of Patent: Aug. 2, 2022

(54) ELECTRONIC GAMING SYSTEM WITH MULTIPLE HAND BASED SIDE WAGER

(71) Applicant: DraftKings, Inc., Boston, MA (US)

(72) Inventor: Kyle Morris, Las Vegas, NV (US)

(73) Assignee: DraftKings, Inc., Boston, MA (US)

( * ) Notice: Subject to any disclaimer, the term of this patent is extended or adjusted under 35 U.S.C. 154(b) by 0 days.

(21) Appl. No.: 17/403,350

(22) Filed: Aug. 16, 2021

Related U.S. Application Data

(60) Provisional application No. 63/215,738, filed on Jun. 28, 2021.

(51) Int. Cl.
*G07F 17/00* (2006.01)
*G07F 19/00* (2006.01)
*G07F 17/32* (2006.01)

(52) U.S. Cl.
CPC ..... *G07F 17/3258* (2013.01); *G07F 17/3262* (2013.01); *G07F 17/3293* (2013.01)

(58) Field of Classification Search
CPC ..... G07F 17/3293
See application file for complete search history.

(56) References Cited

U.S. PATENT DOCUMENTS 9,852,583 B2 * 12/2017 Hall ..... G07F 17/3244
2016/0093168 A1 * 3/2016 Hall ..... A63F 3/00157 463/25

* cited by examiner

*Primary Examiner* — Milap Shah
(74) *Attorney, Agent, or Firm* — Foley & Lardner LLP

(57) ABSTRACT

The present disclosure provides gaming systems having one or more processors coupled to memory. The gaming system can receive a side wager corresponding to a play of a card game. The gaming system can then provide a plurality of hands for the play of the card game. The gaming system can determine the number of the plurality of hands that satisfy a side wager condition, and calculate a first award amount based on the number of the plurality of hands that satisfy the side wager condition. An account of the player can be credited based on the first award amount. The gaming system can receive wagers that each correspond to a respective hand of the card game. Upon completion of the game, the system can determine an award amount for each of the plurality of hands, and adjust a credit balance of an account based on the award amount for each of the plurality of hands.

20 Claims, 18 Drawing Sheets

ELECTRONIC GAMING SYSTEM WITH MULTIPLE HAND BASED SIDE WAGER

CROSS-REFERENCES TO RELATED APPLICATIONS

The present application claims the benefit of and priority to U.S. Provisional Patent Application No. 63/215,738, entitled "ELECTRONIC GAMING SYSTEM WITH MULTIPLE HAND BASED SIDE WAGER," and filed on Jun. 28, 2021, the contents of which is incorporated herein by reference in its entirety.

BACKGROUND

Gaming machines or devices, such as networked gaming devices, can provide awards as a result of gaming events. Players generally place wagers to activate a game, and can receive an award when a winning condition is met. However, it can be challenging to provide engaging interactive gaming content using wagers alone.

SUMMARY

It is therefore advantageous for a system to provide additional engagement features in interactive gaming content, such as additional award opportunities. Conventional interactive gaming content does not include additional reward conditions contingent on features of traditional games. In some cases, these additional reward conditions can be, in part, randomly generated rewards. Randomly generated award amounts, and additional award events in general, can increase player engagement with games and interactive content. Further, cloud computing allows for the distributed provision and processing of interactive gaming features across many player devices, thereby providing improved performance when compared to other implementations. Thus, the systems and methods of this technical solution provide a technical improvement to player device engagement devices by providing additional engagement features not utilized in conventional gaming systems.

At least one aspect of the present disclosure is directed to a gaming system. The gaming system can include one or more processors coupled to memory. The system can receive a side wager corresponding to a play of a card game. The side wager can correspond to a side wager condition. The system can provide, responsive to receiving the side wager, a plurality of hands for the play of the card game. The system can determine a number of the plurality of hands that satisfy a side wager condition. The system can adjust a credit balance of an account by a first award amount calculated based on the number of the plurality of hands that satisfy the side wager condition and the side wager. The system can receive a plurality of wagers for the play of the card game. Each wager of the plurality of wagers can correspond to a respective hand of the play of the card game. The system can, upon completion of the play of the card game, determine a respective second award amount for each of the plurality of hands. The system can adjust the credit balance of the account based on the respective second award amount for each of the plurality of hands.

In some implementations, the card game is blackjack. In some implementations, the system can provide two initial cards for each hand of the plurality of hands. In some implementations, the card game is poker. In some implementations, the system can provide a predetermined number of initial cards for each hand of the plurality of hands. In some implementations, to determine the number of the plurality of hands that that satisfy the side wager condition, the system can compare a total value of each of the plurality of hands to the side wager condition. In some implementations, the side wager condition is a predetermined poker rank. In some implementations, to determine the number of the plurality of hands that that satisfy the side wager condition, the system can compare a respective poker rank of each of the plurality of hands to the predetermined poker rank.

In some implementations, to calculate the first award amount, the system can determine that one of the plurality of hands satisfies the side wager condition. In some implementations, to calculate the first award amount, the system can randomly select a payout ratio from a list of payout ratios responsive to determining that one of the plurality of hands satisfies the side wager condition. In some implementations, to calculate the first award amount, the system can calculate the first award amount based on the side wager and the payout ratio. In some implementations, to calculate the first award amount, the system can randomly select a payout ratio from a list of payout ratios based on the number of the plurality of hands that satisfy the side wager condition. In some implementations, to calculate the first award amount, the system can calculate the first award amount based on the side wager and the payout ratio.

In some implementations, the system can resolve the play of the card game for each of the plurality of hands according to rules of the play of the card game. In some implementations, to resolve the play of the card game, the system can receive a selection for a turn of the play of the card game for each of the plurality of hands. In some implementations, to resolve the play of the card game, the system can resolve the play of the card game according to the selection for the turn for each of the plurality of hands. In some implementations, to receive the plurality of wagers and the side wager, the system can provide, to a client device, a user interface via which a player can place the plurality of wagers and select to participate in the side wager corresponding to the side wager condition. The system can receive the plurality of wagers and the side wager via the user interface to the client device.

At least one other aspect of the present disclosure is directed to a method. The method can include receiving a side wager for a play of a card game, the side wager corresponding to a side wager condition. The method can include providing, responsive to receiving the side wager, a plurality of hands for the play of the card game. The method can include determining a number of the plurality of hands that satisfy a side wager condition. The method can include adjusting a credit balance of an account by a first award amount calculated based on the number of the plurality of hands that satisfy the side wager condition and the side wager. The method can include receiving a plurality of wagers for the play of the card game, each wager of the plurality of wagers corresponding to a respective hand of the play of the card game. The method can include, upon completion of the play of the card game, determining a respective award amount for each of the plurality of hands. The method can include adjusting the credit balance of the account based on the respective second award amount for each of the plurality of hands.

In some implementations, the card game is blackjack. In some implementations, providing the plurality of hands can include providing two initial cards for each hand of the plurality of hands. In some implementations, the card game is poker. In some implementations, providing the plurality of hands can include providing a predetermined number of initial cards for each hand of the plurality of hands. In some implementations, determining the number of the plurality of hands that satisfy the side wager condition can include comparing a total value of each of the plurality of hands to the side wager condition. In some implementations, the side wager condition is a predetermined poker rank. In some implementations, determining the number of the plurality of hands that that satisfy the side wager condition further comprises comparing, by the one or more processors, a respective poker rank of each of the plurality of hands to the predetermined poker rank.

In some implementations, calculating the first award amount can include determining that one of the plurality of hands satisfies the side wager condition. In some implementations, calculating the first award amount can include randomly selecting a payout ratio from a list of payout ratios responsive to determining that one of the plurality of hands satisfies the side wager condition. In some implementations, calculating the first award amount can include calculating the first award amount based on the side wager and the payout ratio. In some implementations, calculating the first award amount can include randomly selecting a payout ratio from a list of payout ratios based on the number of the plurality of hands that satisfy the side wager condition. In some implementations, calculating the first award amount can include calculating the first award amount based on the side wager and the payout ratio.

In some implementations, the method can include resolving the play of the card game for each of the plurality of hands according to rules of the play of the card game. In some implementations, resolving the play of the card game can include receiving a selection for a turn of the play of the card game for each of the plurality of hands. In some implementations, resolving the play of the card game can include resolving the play of the card game according to the selection for the turn for each of the plurality of hands.

At least one other aspect of the present disclosure is directed to a gaming system. The gaming system can include one or more processors coupled to memory. The system can receive a side wager for a play of a card game, the side wager corresponding to a side wager condition. The system can provide, responsive to receiving the side wager, a plurality of hands for the play of the card game. The system can determine that cards of the plurality of hands that satisfy a side wager condition of a plurality of side wager conditions. The system can adjust a credit balance of an account by a first award amount calculated based on the plurality of hands satisfying the side wager condition and the side wager. The system can receive a plurality of wagers for the play of the card game, each wager of the plurality of wagers corresponding to a respective hand of the play of the card game. The system can upon completion of the play of the card game, determine a respective second award amount for each of the plurality of hands. The system can adjust the credit balance of the account of based on the respective second award amount for each of the plurality of hands.

These and other aspects and implementations are discussed in detail below. The foregoing information and the following detailed description include illustrative examples of various aspects and implementations, and provide an overview or framework for understanding the nature and character of the claimed aspects and implementations. The drawings provide illustration and a further understanding of the various aspects and implementations, and are incorporated in and constitute a part of this specification. Aspects can be combined and it will be readily appreciated that features described in the context of one aspect of the invention can be combined with other aspects. Aspects can be implemented in any convenient form. For example, by appropriate computer programs, which may be carried on appropriate carrier media (e.g., computer readable media), which may be tangible carrier media (e.g., disks) or intangible carrier media (e.g., communications signals). Aspects may also be implemented using suitable apparatuses, which may take the form of programmable computers running computer programs arranged to implement the aspect. As used in the specification and in the claims, the singular form of "a", "an", and "the" include plural referents unless the context clearly dictates otherwise.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing. The patent or application file contains at least one drawing executed in color. Copies of this patent or patent application publication with color drawing(s) will be provided by the Office upon request and payment of the necessary fee. In the drawings.

DETAILED DESCRIPTION

Below are detailed descriptions of various concepts related to, and implementations of, techniques, approaches, methods, apparatuses, and systems for providing games with multiple hand based side wagers. The various concepts introduced above and discussed in greater detail below may be implemented in any of numerous ways, as the described concepts are not limited to any particular manner of implementation. Examples of specific implementations and applications are provided primarily for illustrative purposes.

For purposes of reading the description of the various implementations below, the following descriptions of the sections of the Specification and their respective contents may be helpful:

Section A describes a network environment and computing environment which may be useful for practicing embodiments described herein; and Section B describes systems and methods for gaming systems with multiple, hand-based side wagers.

A. Computing and Network Environment

Figure 1A:
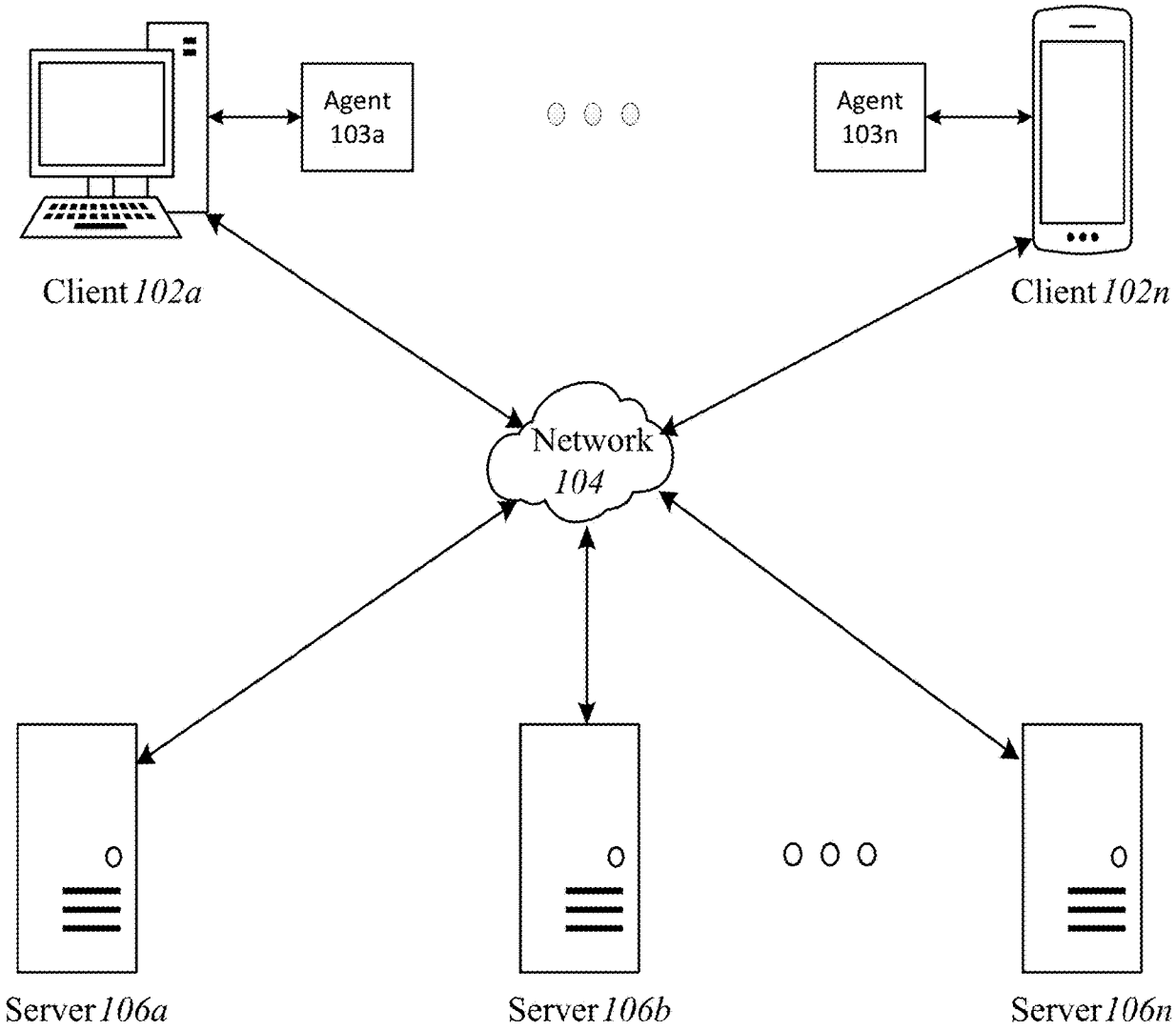
FIG. 1A is a block diagram depicting an embodiment of a network environment comprising a client device in communication with a server device.

Prior to discussing specific implements of the various aspects of this technical solution, it may be helpful to describe aspects of the operating environment as well as associated system components (e.g., hardware elements) in connection with the methods and systems described herein. Referring to FIG. 1A, an embodiment of a network environment is depicted. In brief overview, the network environment includes one or more clients 102*a*-102*n* (also generally referred to as local machine(s) 102, client(s) 102, client node(s) 102, client machine(s) 102, client computer(s) 102, client device(s) 102, endpoint(s) 102, or endpoint node(s) 102) in communication with one or more agents 103*a*-103*n* and one or more servers 106*a*-106*n* (also generally referred to as server(s) 106, node 106, or remote machine(s) 106) via one or more networks 104. In some embodiments, a client 102 has the capacity to function as both a client node seeking access to resources provided by a server and as a server providing access to hosted resources for other clients 102*a*-102*n*.

Although FIG. 1A shows a network 104 between the clients 102 and the servers 106, the clients 102 and the servers 106 may be on the same network 104. In some embodiments, there are multiple networks 104 between the clients 102 and the servers 106. In one of these embodiments, a network 104' (not shown) may be a private network and a network 104 may be a public network. In another of these embodiments, a network 104 may be a private network and a network 104' a public network. In still another of these embodiments, networks 104 and 104' may both be private networks.

The network 104 may be connected via wired or wireless links. Wired links may include Digital Subscriber Line (DSL), coaxial cable lines, or optical fiber lines. The wireless links may include BLUETOOTH, Wi-Fi, Worldwide Interoperability for Microwave Access (WiMAX), an infrared channel or satellite band. The wireless links may also include any cellular network standards used to communicate among mobile devices, including standards that qualify as 1G, 2G, 3G, or 4G. The network standards may qualify as one or more generation of mobile telecommunication standards by fulfilling a specification or standards such as the specifications maintained by International Telecommunication Union. The 3G standards, for example, may correspond to the International Mobile Telecommunications-2000 (IMT-2000) specification, and the 4G standards may correspond to the International Mobile Telecommunications Advanced (IMT-Advanced) specification. Examples of cellular network standards include AMPS, GSM, GPRS, UMTS, LTE, LTE Advanced, Mobile WiMAX, and WiMAX-Advanced. Cellular network standards may use various channel access methods e.g., FDMA, TDMA, CDMA, or SDMA. In some embodiments, different types of data may be transmitted via different links and standards. In other embodiments, the same types of data may be transmitted via different links and standards.

The network 104 may be any type and/or form of network. The geographical scope of the network 104 may vary widely and the network 104 can be a body area network (BAN), a personal area network (PAN), a local-area network (LAN), e.g. Intranet, a metropolitan area network (MAN), a wide area network (WAN), or the Internet. The topology of the network 104 may be of any form and may include, e.g., any of the following: point-to-point, bus, star, ring, mesh, or tree. The network 104 may be an overlay network which is virtual and sits on top of one or more layers of other networks 104'. The network 104 may be of any such network topology as known to those ordinarily skilled in the art capable of supporting the operations described herein. The network 104 may utilize different techniques and layers or stacks of protocols, including, e.g., the Ethernet protocol, the internet protocol suite (TCP/IP), the ATM (Asynchronous Transfer Mode) technique, the SONET (Synchronous Optical Networking) protocol, or the SDH (Synchronous Digital Hierarchy) protocol. The TCP/IP internet protocol suite may include application layer, transport layer, internet layer (including, e.g., IPv6), or the link layer. The network 104 may be a type of a broadcast network, a telecommunications network, a data communication network, or a computer network.

In some embodiments, the system may include multiple, logically-grouped servers 106. In one of these embodiments, the logical group of servers may be referred to as a server farm (not shown) or a machine farm. In another of these embodiments, the servers 106 may be geographically dispersed. In other embodiments, a machine farm may be administered as a single entity. In still other embodiments, the machine farm includes a plurality of machine farms. The servers 106 within each machine farm can be heterogeneous—one or more of the servers 106 or machines 106 can operate according to one type of operating system platform (e.g., WINDOWS NT, manufactured by Microsoft Corp. of Redmond, Wash.), while one or more of the other servers 106 can operate on according to another type of operating system platform (e.g., Unix, Linux, or Mac OS X).

In one embodiment, servers 106 in the machine farm 38 may be stored in high-density rack systems, along with associated storage systems, and located in an enterprise data center. In this embodiment, consolidating the servers 106 in this way may improve system manageability, data security, the physical security of the system, and system performance by locating servers 106 and high performance storage systems on localized high performance networks. Centralizing the servers 106 and storage systems and coupling them with advanced system management tools allows more efficient use of server resources.

The servers 106 of each machine farm do not need to be physically proximate to another server 106 in the same machine farm. Thus, the group of servers 106 logically grouped as a machine farm may be interconnected using a wide-area network (WAN) connection or a metropolitan-area network (MAN) connection. For example, a machine farm may include servers 106 physically located in different continents or different regions of a continent, country, state, city, campus, or room. Data transmission speeds between servers 106 in the machine farm can be increased if the servers 106 are connected using a local-area network (LAN) connection or some form of direct connection. Additionally, a heterogeneous machine farm may include one or more servers 106 operating according to a type of operating system, while one or more other servers 106 execute one or more types of hypervisors rather than operating systems. In these embodiments, hypervisors may be used to emulate virtual hardware, partition physical hardware, virtualize physical hardware, and execute virtual machines that provide access to computing environments, allowing multiple operating systems to run concurrently on a host computer. Native hypervisors may run directly on the host computer. Hypervisors may include VMware ESX/ESXi, manufactured by VMWare, Inc., of Palo Alto, Calif.; the Xen hypervisor, an open source product whose development is overseen by Citrix Systems, Inc.; the HYPER-V hypervisors provided by Microsoft or others. Hosted hypervisors may run within an operating system on a second software level. Examples of hosted hypervisors may include VMware Workstation and VIRTUALBOX.

Management of the machine farm may be de-centralized. For example, one or more servers 106 may comprise components, subsystems and modules to support one or more management services for the machine farm. In one of these embodiments, one or more servers 106 provide functionality for management of dynamic data, including techniques for handling failover, data replication, and increasing the robustness of the machine farm. Each server 106 may communicate with a persistent store and, in some embodiments, with a dynamic store.

Server 106 may be a file server, application server, web server, proxy server, appliance, network appliance, gateway, gateway server, virtualization server, deployment server, SSL VPN server, or firewall. In one embodiment, the server 106 may be referred to as a remote machine or a node. In another embodiment, a plurality of nodes 290 may be in the path between any two communicating servers.

Figure 1B:
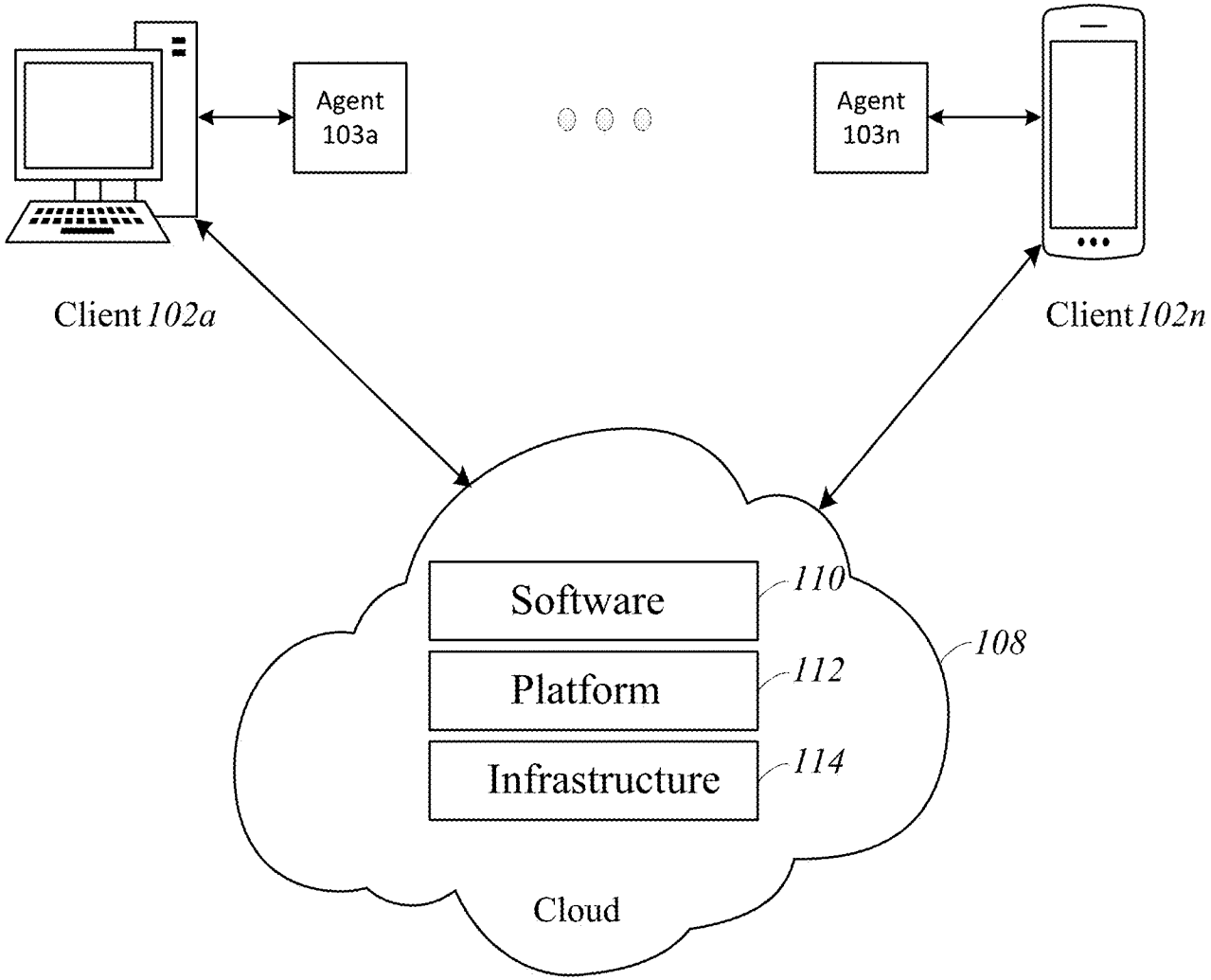
FIG. 1B is a block diagram depicting a cloud computing environment comprising a client device in communication with cloud service providers.

Referring to FIG. 1B, a cloud computing environment is depicted. A cloud computing environment may provide client 102 with one or more resources provided by a network environment. The cloud computing environment may include one or more clients 102*a*-102*n*, in communication with respective agents 103*a*-103*n* and with the cloud 108 over one or more networks 104. Clients 102 may include, e.g., thick clients, thin clients, and zero clients. A thick client may provide at least some functionality even when disconnected from the cloud 108 or servers 106. A thin client or a zero client may depend on the connection to the cloud 108 or server 106 to provide functionality. A zero client may depend on the cloud 108 or other networks 104 or servers 106 to retrieve operating system data for the client device. The cloud 108 may include back end platforms, e.g., servers 106, storage, server farms, or data centers.

The cloud 108 may be public, private, or hybrid. Public clouds may include public servers 106 that are maintained by third parties to the clients 102 or the owners of the clients. The servers 106 may be located off-site in remote geographical locations as disclosed above or otherwise. Public clouds may be connected to the servers 106 over a public network. Private clouds may include private servers 106 that are physically maintained by clients 102 or owners of clients. Private clouds may be connected to the servers 106 over a private network 104. Hybrid clouds 108 may include both the private and public networks 104 and servers 106.

The cloud 108 may also include a cloud based delivery, e.g., Software as a Service (SaaS) 110, Platform as a Service (PaaS) 112, and Infrastructure as a Service (IaaS) 114. IaaS may refer to a person renting the use of infrastructure resources that are needed during a specified time period. IaaS providers may offer storage, networking, servers or virtualization resources from large pools, allowing entities to quickly scale up by accessing more resources as needed. Examples of IaaS include AMAZON WEB SERVICES provided by Amazon.com, Inc., of Seattle, Wash., RACKSPACE CLOUD provided by Rackspace US, Inc., of San Antonio, Tex., Google Compute Engine provided by Google, Inc. of Mountain View, Calif., or RIGHTSCALE provided by RightScale, Inc., of Santa Barbara, Calif. PaaS providers may offer functionality provided by IaaS, including, e.g., storage, networking, servers, or virtualization, as well as additional resources such as, e.g., the operating system, middleware, or runtime resources. Examples of PaaS include WINDOWS AZURE provided by Microsoft Corp., Google App Engine provided by Google Inc., and HEROKU provided by Heroku, Inc. of San Francisco, Calif. SaaS providers may offer the resources that PaaS provides, including storage, networking, servers, virtualization, operating system, middleware, or runtime resources. In some embodiments, SaaS providers may offer additional resources including, e.g., data and application resources. Examples of SaaS include GOOGLE APPS provided by Google Inc., SALESFORCE provided by Salesforce.com, Inc. of San Francisco, Calif., or OFFICE 365 provided by Microsoft Corp. Examples of SaaS may also include data storage providers, e.g. DROPBOX provided by Dropbox, Inc. of San Francisco, Calif., Microsoft SKYDRIVE provided by Microsoft Corp., Google Drive provided by Google, Inc., or Apple ICLOUD provided by Apple, Inc. of Cupertino, Calif.

Clients 102 may access IaaS resources with one or more IaaS standards, including, e.g., Amazon Elastic Compute Cloud (EC2), Open Cloud Computing Interface (OCCI), Cloud Infrastructure Management Interface (CIMI), or OpenStack standards. Some IaaS standards may allow clients access to resources over HTTP, and may use Representational State Transfer (REST) protocol or Simple Object Access Protocol (SOAP). Clients 102 may access PaaS resources with different PaaS interfaces. Some PaaS interfaces use HTTP packages, standard Java APIs, JavaMail API, Java Data Objects (JDO), Java Persistence API (JPA), Python APIs, web integration APIs for different programming languages including, e.g., Rack for Ruby, WSGI for Python, or PSGI for Perl, or other APIs that may be built on REST, HTTP, XML, or other protocols. Clients 102 may access SaaS resources through the use of web-based user interfaces, provided by a web browser (e.g. GOOGLE CHROME, Microsoft INTERNET EXPLORER, or FIREFOX provided by Mozilla Foundation of Mountain View, Calif.). Clients 102 may also access SaaS resources through smartphone or tablet applications, including, e.g., Salesforce Sales Cloud or the Google Drive app. Clients 102 may also access SaaS resources through the client operating system, including, e.g., Windows file system for DROPBOX.

In some embodiments, access to IaaS, PaaS, or SaaS resources may be authenticated. For example, a server or authentication server may authenticate a player via security certificates, HTTPS, or API keys. API keys may include various encryption standards such as, e.g., Advanced Encryption Standard (AES). Data resources may be sent over Transport Layer Security (TLS) or Secure Sockets Layer (SSL).

Figure 1C:
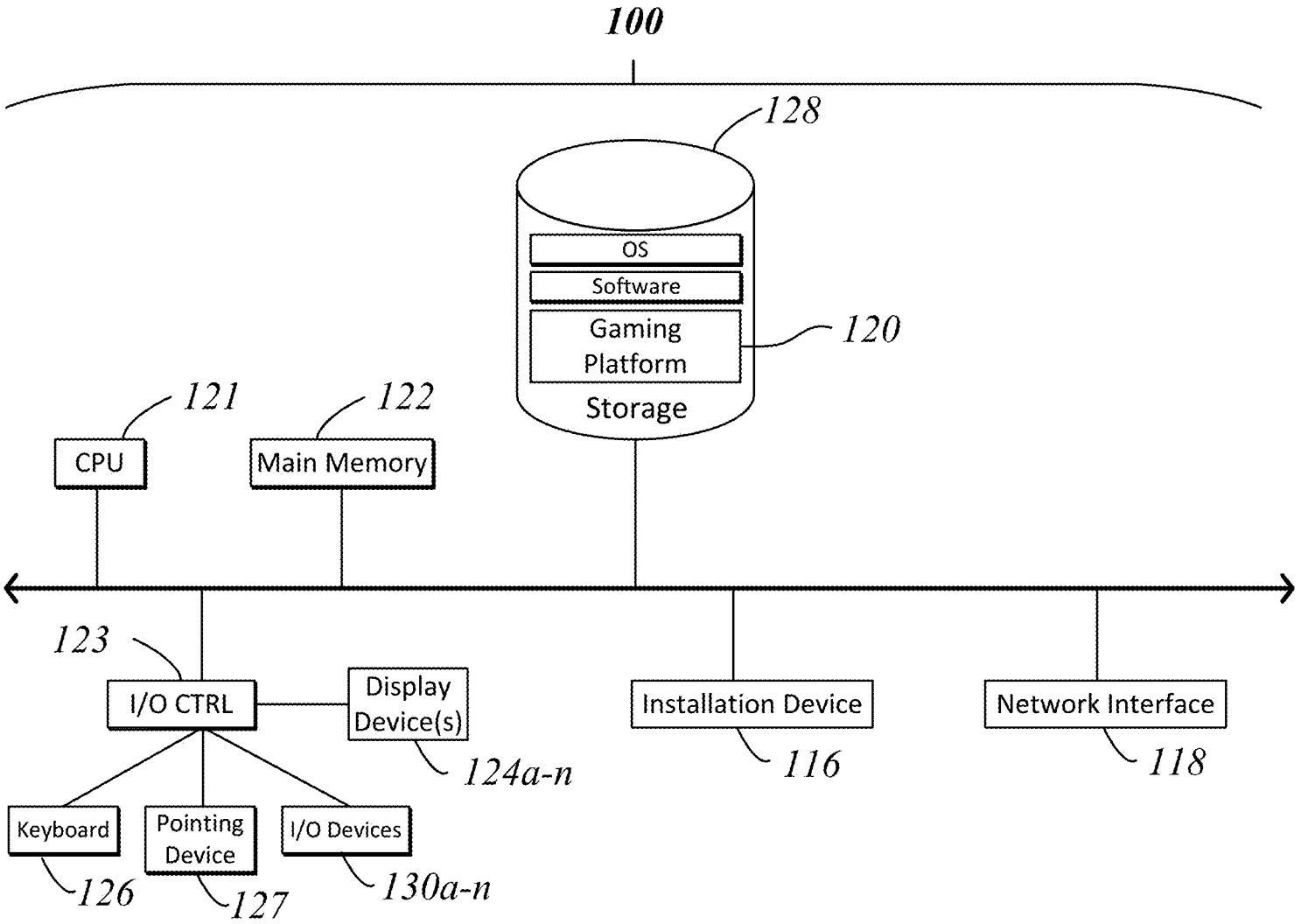
FIGS. 1C and 1D are block diagrams depicting embodiments of computing devices useful in connection with the methods and systems described herein.
Figure 1D:
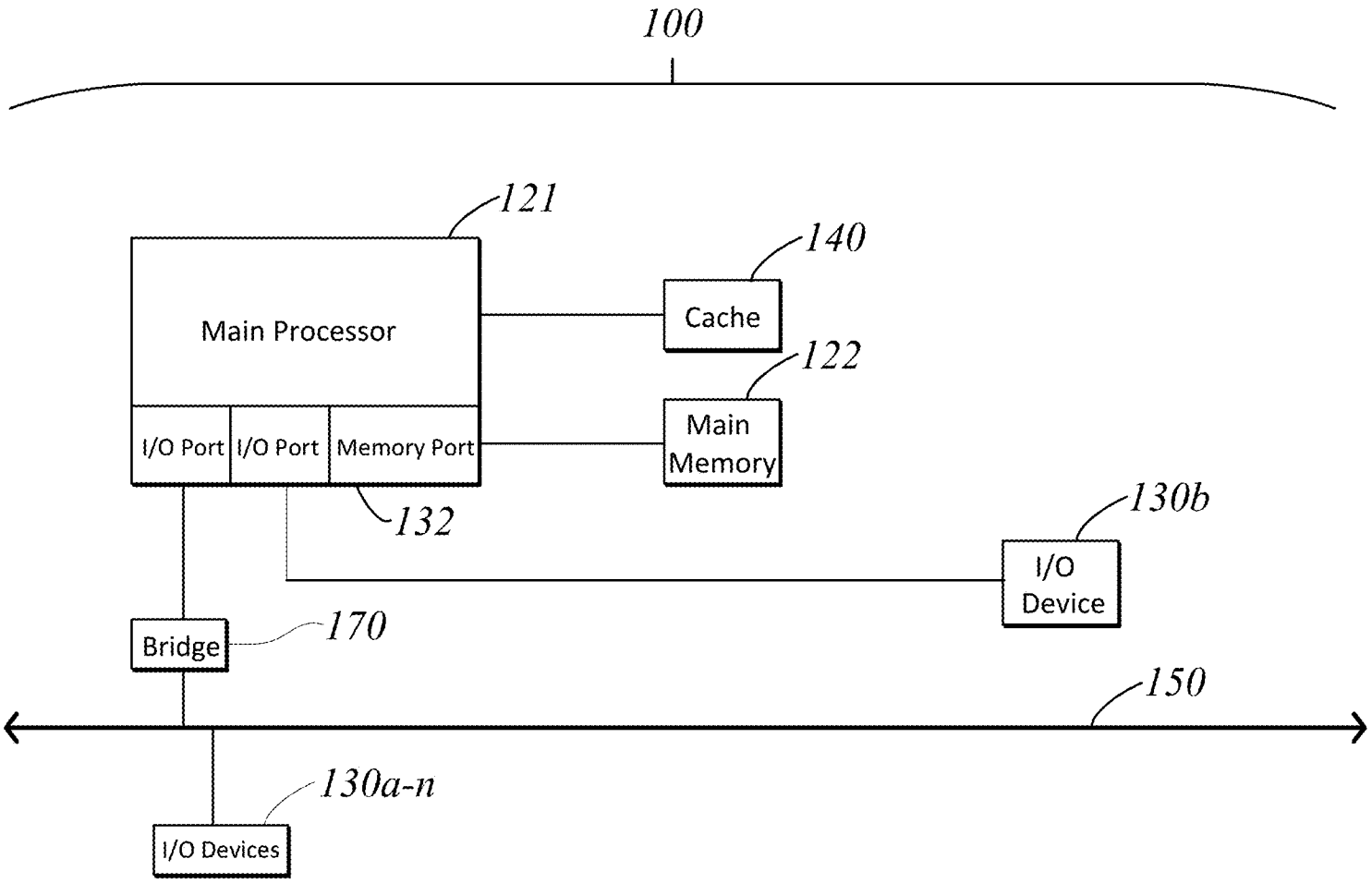

The client 102 and server 106 may be deployed as and/or executed on any type and form of computing device, e.g., a computer, network device or appliance capable of communicating on any type or form of network and performing the operations described herein. FIGS. 1C and 1D depict block diagrams of a computing device 100 useful for practicing an embodiment of the client 102 or a server 106. As shown in FIGS. 1C and 1D, each computing device 100 includes a central processing unit 121 and a main memory unit 122. As shown in FIG. 1C, a computing device 100 may include a storage device 128, an installation device 116, a network interface 118, an I/O controller 123, display devices 124*a*-124*n*, a keyboard 126 and a pointing device 127, e.g., a mouse. The storage device 128 may include, without limitation, an operating system, software, and gaming platform 120, which can implement any of the features of a gaming server (or gaming system) described herein. As shown in FIG. 1D, each computing device 100 may also include additional optional elements, e.g. a memory port 132, a bridge 170, one or more input/output devices 130*a*-130*n* (generally referred to using reference numeral 130), and a cache memory 140 in communication with the central processing unit 121.

The central processing unit 121 is any logic circuitry that responds to and processes instructions fetched from the main memory unit 122. In many embodiments, the central processing unit 121 is a microprocessor, e.g., those manufactured by Intel Corporation of Mountain View, Calif.; those manufactured by Motorola Corporation of Schaumburg, Ill.; the ARM processor and TEGRA system on a chip (SoC) manufactured by Nvidia of Santa Clara, Calif.; the POWER7 processor manufactured by International Business Machines of White Plains, N.Y.; or those manufactured by Advanced Micro Devices of Sunnyvale, Calif. The computing device 100 may be based on any of these processors, or any other processor capable of operating as described herein. The CPU 121 may utilize instruction level parallelism, thread level parallelism, different cache levels, and multi-core processors. A multi-core processor may include two or more processing units on a single computing component. Examples of multi-core processors include the AMD PHENOM IIX2, INTEL CORE i5, INTEL CORE i7, and INTEL CORE i9.

Main memory unit 122 may include one or more memory chips capable of storing data and allowing any storage location to be directly accessed by the microprocessor 121. Main memory unit 122 may be volatile and faster than storage 128 memory. Main memory units 122 may be Dynamic random access memory (DRAM) or any variants, including static random access memory (SRAM), Burst SRAM or SynchBurst SRAM (BSRAM), Fast Page Mode DRAM (FPM DRAM), Enhanced DRAM (EDRAM), Extended Data Output RAM (EDO RAM), Extended Data Output DRAM (EDO DRAM), Burst Extended Data Output DRAM (BEDO DRAM), Single Data Rate Synchronous DRAM (SDR SDRAM), Double Data Rate SDRAM (DDR SDRAM), Direct Rambus DRAM (DRDRAM), or Extreme Data Rate DRAM (XDR DRAM). In some embodiments, the main memory 122 or the storage 128 may be non-volatile, e.g., non-volatile read access memory (NVRAM), flash memory non-volatile static RAM (nvSRAM), Ferroelectric RAM (FeRAM), Magnetoresistive RAM (MRAM), Phase-change memory (PRAM), conductive-bridging RAM (CBRAM), Silicon-Oxide-Nitride-Oxide-Silicon (SONOS), Resistive RAM (RRAM), Racetrack, Nano-RAM (NRAM), or Millipede memory. The main memory 122 may be based on any of the above described memory chips, or any other available memory chips capable of operating as described herein. In the embodiment shown in FIG. 1C, the processor 121 communicates with main memory 122 via a system bus 150 (described in more detail below). FIG. 1D depicts an embodiment of a computing device 100 in which the processor communicates directly with main memory 122 via a memory port 132. For example, in FIG. 1D the main memory 122 may be DRDRAM.

FIG. 1D depicts an embodiment in which the main processor 121 communicates directly with cache memory 140 via a secondary bus, sometimes referred to as a backside bus. In other embodiments, the main processor 121 communicates with cache memory 140 using the system bus 150. Cache memory 140 typically has a faster response time than main memory 122 and is typically provided by SRAM, BSRAM, or EDRAM. In the embodiment shown in FIG. 1D, the processor 121 communicates with various I/O devices 130 via a local system bus 150. Various buses may be used to connect the central processing unit 121 to any of the I/O devices 130, including a PCI bus, a PCI-X bus, or a PCI-Express bus, or a NuBus. For embodiments in which the I/O device is a video display 124, the processor 121 may use an Advanced Graphics Port (AGP) to communicate with the display 124 or the I/O controller 123 for the display 124. FIG. 1D depicts an embodiment of a computer 100 in which the main processor 121 communicates directly with I/O device 130*b* or other processors 121' via HYPERTRANSPORT, RAPIDIO, or INFINIBAND communications technology. FIG. 1D also depicts an embodiment in which local busses and direct communication are mixed: the processor 121 communicates with I/O device 130*a* using a local interconnect bus while communicating with I/O device 130*b* directly.

A wide variety of I/O devices 130*a*-130*n* may be present in the computing device 100. Input devices may include keyboards, mice, trackpads, trackballs, touchpads, touch mice, multi-touch touchpads and touch mice, microphones, multi-array microphones, drawing tablets, cameras, single-lens reflex camera (SLR), digital SLR (DSLR), CMOS sensors, accelerometers, infrared optical sensors, pressure sensors, magnetometer sensors, angular rate sensors, depth sensors, proximity sensors, ambient light sensors, gyroscopic sensors, or other sensors. Output devices may include video displays, graphical displays, speakers, headphones, inkjet printers, laser printers, and 3D printers.

Devices 130*a*-130*n* may include a combination of multiple input or output devices, including, e.g., Microsoft KINECT, Nintendo Wiimote for the WII, Nintendo WII U GAMEPAD, or Apple IPHONE. Some devices 130*a*-130*n* allow gesture recognition inputs through combining some of the inputs and outputs. Some devices 130*a*-130*n* provides for facial recognition which may be utilized as an input for different purposes including authentication and other commands. Some devices 130*a*-130*n* provide for voice recognition and input, including, e.g., Microsoft KINECT, SIRI for IPHONE by Apple, Google Now or Google Voice Search.

Additional devices 130*a*-130*n* have both input and output capabilities, including, e.g., haptic feedback devices, touchscreen displays, or multi-touch displays. Touchscreen, multi-touch displays, touchpads, touch mice, or other touch sensing devices may use different technologies to sense touch, including, e.g., capacitive, surface capacitive, projected capacitive touch (PCT), in-cell capacitive, resistive, infrared, waveguide, dispersive signal touch (DST), in-cell optical, surface acoustic wave (SAW), bending wave touch (BWT), or force-based sensing technologies. Some multi-touch devices may allow two or more contact points with the surface, allowing advanced functionality including, e.g., pinch, spread, rotate, scroll, or other gestures. Some touchscreen devices, including, e.g., Microsoft PIXELSENSE or Multi-Touch Collaboration Wall, may have larger surfaces, such as on a table-top or on a wall, and may also interact with other electronic devices. Some I/O devices 130*a*-130*n*, display devices 124*a*-124*n*, or a group of devices may be augment reality devices. The I/O devices may be controlled by an I/O controller 123 as shown in FIG. 1C. The I/O controller may control one or more I/O devices 130*a*-130*n*, such as, e.g., a keyboard 126 and a pointing device 127, e.g., a mouse or optical pen. Furthermore, an I/O device 130 may also provide storage and/or an installation medium 116 for the computing device 100. In still other embodiments, the computing device 100 may provide USB connections (not shown) to receive handheld USB storage devices. In further embodiments, an I/O device 130 may be a bridge between the system bus 150 and an external communication bus, e.g. a USB bus, a SCSI bus, a FireWire bus, an Ethernet bus, a Gigabit Ethernet bus, a Fibre Channel bus, or a Thunderbolt bus.

In some embodiments, display devices 124*a*-124*n* may be connected to I/O controller 123. Display devices may include, e.g., liquid crystal displays (LCD), thin film transistor LCD (TFT-LCD), blue phase LCD, electronic papers (e-ink) displays, flexile displays, light emitting diode displays (LED), digital light processing (DLP) displays, liquid crystal on silicon (LCOS) displays, organic light-emitting diode (OLED) displays, active-matrix organic light-emitting diode (AMOLED) displays, liquid crystal laser displays, time-multiplexed optical shutter (TMOS) displays, or 3D displays. Examples of 3D displays may use, e.g. stereoscopy, polarization filters, active shutters, or autostereoscopic techniques. Display devices 124*a*-124*n* may also be a head-mounted display (HMD). In some embodiments, display devices 124*a*-124*n* or the corresponding I/O controllers 123 may be controlled through or have hardware support for OPENGL or DIRECTX API or other graphics libraries.

In some embodiments, the computing device 100 may include or connect to multiple display devices 124*a*-124*n*, which each may be of the same or different type and/or form. As such, any of the I/O devices 130*a*-130*n* and/or the I/O controller 123 may include any type and/or form of suitable hardware, software, or combination of hardware and software to support, enable or provide for the connection and use of multiple display devices 124*a*-124*n* by the computing device 100. For example, the computing device 100 may include any type and/or form of video adapter, video card, driver, and/or library to interface, communicate, connect or otherwise use the display devices 124*a*-124*n*. In one embodiment, a video adapter may include multiple connectors to interface to multiple display devices 124*a*-124*n*. In other embodiments, the computing device 100 may include multiple video adapters, with each video adapter connected to one or more of the display devices 124*a*-124*n*. In some embodiments, any portion of the operating system 121 of the computing device 100 may be configured for using multiple displays 124*a*-124*n*. In other embodiments, one or more of the display devices 124*a*-124*n* may be provided by one or more other computing devices connected to the computing device 100, via the network 104. In some embodiments software may be designed and constructed to use another computer's display device as a second display device 124*a* for the computing device 100. For example, in one embodiment, an Apple iPad may connect to a computing device 100 and use the display of the device 100 as an additional display screen 124 that may be used as an extended desktop. One ordinarily skilled in the art will recognize and appreciate the various ways and embodiments that a computing device 100 may be configured to have multiple display devices 124*a*-124*n*.

Referring again to FIG. 1C, the computing device 100 may comprise a storage device 128 (e.g. one or more hard disk drives or redundant arrays of independent disks) for storing an operating system or other related software, and for storing application software programs such as any program related to the gaming platform 120. Examples of storage device 128 include, e.g., hard disk drive (HDD); optical drive including CD drive, DVD drive, or BLU-RAY drive; solid-state drive (SSD); USB flash drive; or any other device suitable for storing data. Some storage devices 128 may include multiple volatile and non-volatile memories, including, e.g., solid state hybrid drives that combine hard disks with solid state cache. Some storage devices 128 may be non-volatile, mutable, or read-only. Some storage devices 128 may be internal and connect to the computing device 100 via a bus 150. Some storage devices 128 may be external and connect to the computing device 100 via an I/O device 130 that provides an external bus. Some storage device 128 may connect to the computing device 100 via the network interface 118 over a network 104, including, e.g., the Remote Disk for MACBOOK AIR by Apple. Some client devices 102 may not require a non-volatile storage device 128 and may be thin clients or zero clients 102. Some storage device 128 may also be used as an installation device 116, and may be suitable for installing software and programs. Additionally, the operating system and the software can be run from a bootable medium, for example, a bootable CD, e.g. KNOPPIX, a bootable CD for GNU/Linux that is available as a GNU/Linux distribution from knoppix.net.

The computing device 100 may also install software or application from an application distribution platform. Examples of application distribution platforms include the App Store for iOS provided by Apple, Inc., the Mac App Store provided by Apple, Inc., GOOGLE PLAY for Android OS provided by Google Inc., Chrome Webstore for CHROME OS provided by Google Inc., and Amazon Appstore for Android OS and KINDLE FIRE provided by Amazon.com, Inc. An application distribution platform may facilitate installation of software on a client device 102. An application distribution platform may include a repository of applications on a server 106 or a cloud 108, which the clients 102*a*-102*n* may access over a network 104. An application distribution platform may include application developed and provided by various developers. A user of a client device 102 may select, purchase and/or download an application via the application distribution platform.

Furthermore, the computing device 100 may include a network interface 118 to interface to the network 104 through a variety of connections including, but not limited to, standard telephone lines LAN or WAN links (e.g., 802.11, T1, T3, Gigabit Ethernet, Infiniband), broadband connections (e.g., ISDN, Frame Relay, ATM, Gigabit Ethernet, Ethernet-over-SONET, ADSL, VDSL, BPON, GPON, fiber optical including FiOS), wireless connections, or some combination of any or all of the above. Connections can be established using a variety of communication protocols (e.g., TCP/IP, Ethernet, ARCNET, SONET, SDH, Fiber Distributed Data Interface (FDDI), IEEE 802.11a/b/g/n/ac CDMA, GSM, WiMax and direct asynchronous connections). In one embodiment, the computing device 100 communicates with other computing devices 100' via any type and/or form of gateway or tunneling protocol e.g. Secure Socket Layer (SSL) or Transport Layer Security (TLS), or the Citrix Gateway Protocol manufactured by Citrix Systems, Inc. of Ft. Lauderdale, Fla. The network interface 118 may comprise a built-in network adapter, network interface card, PCMCIA network card, EXPRESSCARD network card, card bus network adapter, wireless network adapter, USB network adapter, modem or any other device suitable for interfacing the computing device 100 to any type of network capable of communication and performing the operations described herein.

A computing device 100 of the sort depicted in FIGS. 1C and 1D may operate under the control of an operating system, which controls scheduling of tasks and access to system resources. The computing device 100 can be running any operating system such as any of the versions of the MICROSOFT WINDOWS operating systems, the different releases of the Unix and Linux operating systems, any version of the MAC OS for Macintosh computers, any embedded operating system, any real-time operating system, any open source operating system, any proprietary operating system, any operating systems for mobile computing devices, or any other operating system capable of running on the computing device and performing the operations described herein. Typical operating systems include, but are not limited to: WINDOWS 2000, WINDOWS Server 2012, WINDOWS CE, WINDOWS Phone, WINDOWS XP, WINDOWS VISTA, and WINDOWS 7, WINDOWS RT, and WINDOWS 8 all of which are manufactured by Microsoft Corp.; MAC OS and iOS, manufactured by Apple, Inc. of Cupertino, Calif.; and Linux, a freely-available operating system, e.g. Linux Mint distribution ("distro") or Ubuntu, distributed by Canonical Ltd. of London, United Kingdom; or Unix or other Unix-like derivative operating systems; and Android, designed by Google, Inc., among others. Some operating systems, including, e.g., the CHROME OS by Google, may be used on zero clients or thin clients 102, including, e.g., CHROMEBOOKS.

The computer system 100 can be any workstation; telephone; desktop computer; laptop or notebook computer; netbook; ULTRABOOK; tablet; server; handheld computer; mobile telephone; smartphone or other portable telecommunications device; media playing device; gaming system; mobile computing device; or any other type and/or form of computing, telecommunications, or media device that is capable of communication. The computer system 100 has sufficient processor power and memory capacity to perform the operations described herein. In some embodiments, the computing device 100 may have different processors, operating systems, and input devices consistent with the device 100. The Samsung GALAXY smartphones, e.g., operate under the control of Android operating system developed by Google, Inc. GALAXY smartphones receive input via a touch interface.

In some embodiments, the computing device 100 is a gaming system. For example, the computer system 100 may comprise: a PLAYSTATION 3, a PLAYSTATION 4, PLAYSTATION 5, PERSONAL PLAYSTATION PORTABLE (PSP), or a PLAYSTATION VITA device manufactured by the Sony Corporation of Tokyo, Japan; a NINTENDO DS, NINTENDO 3DS, NINTENDO WII, NINTENDO WII U, or a NINTENDO SWITCH device manufactured by Nintendo Co., Ltd., of Kyoto, Japan; or an XBOX 360, an XBOX ONE, an XBOX ONE S, or an XBOX ONE S device manufactured by the Microsoft Corp.

In some embodiments, the computing device 100 is a digital audio player such as the Apple IPOD, IPOD Touch, and IPOD NANO lines of devices, manufactured by Apple Computer of Cupertino, Calif. Some digital audio players may have other functionality, including, e.g., a gaming system or any functionality made available by an application from a digital application distribution platform. For example, the IPOD Touch may access the Apple App Store. In some embodiments, the computing device 100 is a portable media player or digital audio player supporting file formats including, but not limited to MP3; WAV; M4A/AAC; WMA Protected AAC; AIFF; Audible audiobook; Apple Lossless audio file formats; and .mov, .m4v, and .mp4 MPEG-4 (H.264/MPEG-4 AVC) video file formats.

In some embodiments, the computing device 100 is a tablet e.g. the IPAD line of devices by Apple; GALAXY TAB family of devices by Samsung; or KINDLE FIRE, by Amazon.com, Inc. of Seattle, Wash. In other embodiments, the computing device 100 is an eBook reader, e.g. the KINDLE family of devices by Amazon.com, or NOOK family of devices by Barnes & Noble, Inc. of New York City, N.Y.

In some embodiments, the client device 102 includes a combination of devices, e.g., a smartphone combined with a digital audio player or portable media player. For example, one of these embodiments is a smartphone, e.g., the IPHONE family of smartphones manufactured by Apple, Inc.; a Samsung GALAXY family of smartphones manufactured by Samsung, Inc.; or a Motorola DROID family of smartphones. In yet another embodiment, the client device 102 is a laptop or desktop computer equipped with a web browser and a microphone and speaker system, e.g. a telephony headset. In these embodiments, the client devices 102 are web-enabled and can receive and initiate phone calls. In some embodiments, a laptop or desktop computer is also equipped with a webcam or other video capture device that enables video chat and video call.

In some embodiments, the status of one or more machines (client devices 102' and/or servers 106') in the network 104 are monitored, generally as part of network management. In one of these embodiments, the status of a machine may include an identification of load information (e.g., the number of processes on the machine, CPU 121, and memory utilization), of port information (e.g., the number of available communication ports and the port addresses), or of session status (e.g., the duration and type of processes, and whether a process is active or idle). In another of these embodiments, this information may be identified by a plurality of metrics, and the plurality of metrics can be applied at least in part towards decisions in load distribution, network traffic management, and network failure recovery as well as any aspects of operations of the present solution described herein. Aspects of the operating environments and components described above will become apparent in the context of the systems and methods disclosed herein.

B. Gaming Systems with Multiple Hand Based Side Wagers

The systems and methods of this technical solution provide techniques for improved gaming systems that provide opportunities for additional bonus awards in response to in-game events. The gaming servers described herein can be implemented, for example, in a cloud computing environment, such as the cloud computing environment 108 described herein above in conjunction with FIGS. 1A and 1B. In addition, in some implementations, the gaming functionalities need not take place at a server 106 that communicates with a client device 102, but may instead be performed solely by a single gaming system including one or more processing circuits. The gaming servers or systems described herein can provide additional wagering opportunities that operate independently from the outcome of a particular game. For example, a gaming server can provide additional opportunities to wager by providing additional, unconventional conditions on which side wagers can be placed. Side wagers are wagers that are placed on conditions of a game that are independent from the final outcome of a game. These additional wagering opportunities allow a player to risk a specified amount of credits for an opportunity to win more credits. The amount won from the side wager can be referred to as a "side wager award," or an "additional award amount."

In addition, in some implementations, the player can be provided with a payout according to the additional wager prior to a betting round in the game. The player then has the opportunity to place potentially more credits on each of hands of the play of the card game following side wager. This can provide a player with additional strategy considerations when engaging with the gaming systems described. For example, the player can allocate additional credits that were won in the side wager on one or more hands of the play of the game.

The systems and methods described herein improve upon this principle by providing additional opportunities for the player to be awarded with additional credits, often accompanied by a corresponding risk taken by the player. In some implementations, an additional award can be provided based on an in-game condition satisfying a target criteria. For example, in a circumstance where a player plays multiple hands of a card game in parallel, such as blackjack, one such target criteria can be a predetermined number of the multiple hands matching a predetermined score when dealt to a player in a computer environment (e.g., an application executing on a mobile device, etc.). In some implementations, the predetermined target score can be a score of twenty, and the number of initially dealt hands that match the predetermined target score can be used to determine overall payout odds for the side wager. The side wager can be placed independent of wagers placed on the hands in the game. In some implementations, the target criteria can be initiated in response to an indication that the player intends to engage in an additional award opportunity. In other words, the additional award opportunity can, in some implementations, provided as an option, rather than a requirement. However, it should be understood that in some implementations, the additional award opportunities described herein may be enabled without player interaction, and cannot be disabled.

The systems and methods described herein can, in some implementations, leverage cloud computing and remote gaming technology to provide games with additional award opportunities to player devices, such as laptops, smart phones, personal computers, smart televisions, or other such computing devices 100. Although certain aspects of the computing systems 100 described herein are represented as taking place over a network 104, it should be understood that similar operations can take place on a single gaming device, such as a video poker machine, or another type of independent gaming device that may not require communications between a gaming server 106 and a separate gaming client 102 to effectuate the operations described herein. These and other features of gaming devices are described in greater detail herein below.

Various examples of additional award opportunities are described herein. For example, additional target conditions that allow a player to provide side wagers are shown in FIGS. 3A-3L. As shown in FIGS. 3A-3L, a mobile device executes an application (e.g., a native application, a web-based application, etc.), which communicates with a gaming server 106. As described above, in some implementations, the operations described herein need not be executed remotely, and can instead be executed by a single gaming device or gaming system that does not necessarily communicate with a remote gaming server. In implementations where a remote gaming server 106 performs the operations described herein, the gaming server 106 can be responsible for providing hands to a player, receiving wagers from the player, receiving additional wagers from the player, and resolving both the additional wagers (e.g., calculating payouts for additional/side wagers, etc.) and the outcome of a game. Further details of the gaming server 106 are described herein in connection with FIG. 2.

Figure 2:
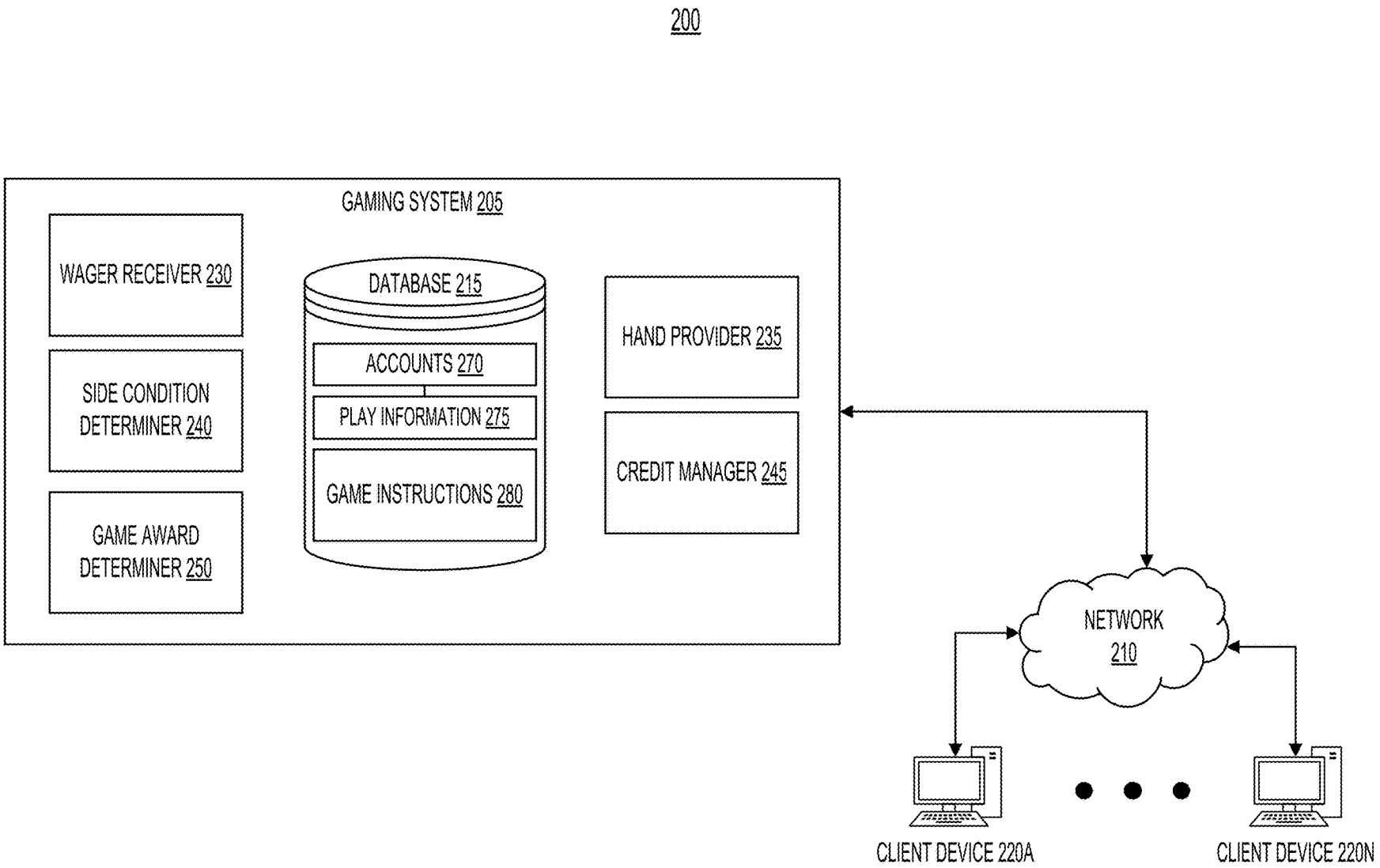
FIG. 2 illustrates a block diagram of an example system for providing gaming system functionalities with additional award opportunities, in accordance with one or more implementations.

Referring now to FIG. 2, depicted is a block diagram of an example system 200 for providing gaming system functionalities with additional award opportunities, in accordance with one or more implementations. The system 200 can include at least one gaming system 205, at least one network 210, and one or more client devices 220A-220N (sometimes generally referred to as client device(s) 220). The gaming system 205 can include at least one wager receiver 230, at least one hand provider 235, at least one value side condition determiner 240, at least one credit manager 245, at least one game award determiner 250, and at least one database 215. The database 215 can include one or more accounts 270, one or more play information 275 data structures (sometimes generally referred to as the play information 275), and one or more game instructions 280 (sometimes generally referred to as the game instruction(s) 280). In some implementations, the database 215 can be external to the data processing system 215, for example, as a part of a cloud computing system or an external computing device in communication with the devices (e.g., the gaming system 205, the client devices 220, etc.) of the system 200 via the network 210.

Each of the components (e.g., the gaming system 205, the network 210, the client devices 220, the wager receiver 230, the hand provider 235, the value side condition determiner 240, the credit manager 245, the game award determiner 250, the database 215, etc.) of the system 200 can be implemented using the hardware components or a combination of software with the hardware components of a computing system, such as the computing system 100 detailed herein in conjunction with FIGS. 1A-1D, or any other computing system described herein. Each of the components of the gaming system 205 can perform the functionalities detailed herein.

The gaming system 205 can include at least one processor and a memory, e.g., a processing circuit. The memory can store processor-executable instructions that, when executed by processor, cause the processor to perform one or more of the operations described herein. The processor may include a microprocessor, an application-specific integrated circuit (ASIC), a field-programmable gate array (FPGA), etc., or combinations thereof. The memory may include, but is not limited to, electronic, optical, magnetic, or any other storage or transmission device capable of providing the processor with program instructions. The memory may further include a floppy disk, CD-ROM, DVD, magnetic disk, memory chip, ASIC, FPGA, read-only memory (ROM), random-access memory (RAM), electrically erasable programmable ROM (EEPROM), erasable programmable ROM (EPROM), flash memory, optical media, or any other suitable memory from which the processor can read instructions. The instructions may include code from any suitable computer programming language. The gaming system 205 can include one or more computing devices or servers that can perform various functions as described herein. The gaming system 205 can include any or all of the components and perform any or all of the functions of the computer system 100 described herein in conjunction with FIGS. 1A-1D.

The network 210 can include computer networks such as the Internet, local, wide, metro or other area networks, intranets, satellite networks, other computer networks such as voice or data mobile phone communication networks, and combinations thereof. The gaming system 205 of the system 200 can communicate via the network 210, for instance with one or more client devices 220. The network 210 may be any form of computer network that can relay information between the gaming system 205, the one or more client devices 220, and one or more information sources, such as web servers or external databases, amongst others. In some implementations, the network 210 may include the Internet and/or other types of data networks, such as a local area network (LAN), a wide area network (WAN), a cellular network, a satellite network, or other types of data networks. The network 210 may also include any number of computing devices (e.g., computers, servers, routers, network switches, etc.) that are configured to receive and/or transmit data within the network 210. The network 210 may further include any number of hardwired and/or wireless connections. Any or all of the computing devices described herein (e.g., the gaming system 205, the one or more client devices 220, the computer system 100, etc.) may communicate wirelessly (e.g., via WiFi, cellular, radio, etc.) with a transceiver that is hardwired (e.g., via a fiber optic cable, a CAT5 cable, etc.) to other computing devices in the network 210. Any or all of the computing devices described herein (e.g., the gaming system 205, the one or more client devices 220, the computer system 100, etc.) may also communicate wirelessly with the computing devices of the network 210 via a proxy device (e.g., a router, network switch, or gateway). In some implementations, the network 210 can be similar to or can include the network 104 or the cloud 108 described herein above in conjunction with FIGS. 1A and 1B.

Each of the client devices 220 can include at least one processor and a memory, e.g., a processing circuit. The memory can store processor-executable instructions that, when executed by processor, cause the processor to perform one or more of the operations described herein. The processor can include a microprocessor, an application-specific integrated circuit (ASIC), a field-programmable gate array (FPGA), etc., or combinations thereof. The memory can include, but is not limited to, electronic, optical, magnetic, or any other storage or transmission device capable of providing the processor with program instructions. The memory can further include a floppy disk, CD-ROM, DVD, magnetic disk, memory chip, ASIC, FPGA, read-only memory (ROM), random-access memory (RAM), electrically erasable programmable ROM (EEPROM), erasable programmable ROM (EPROM), flash memory, optical media, or any other suitable memory from which the processor can read instructions. The instructions can include code from any suitable computer programming language. The client devices 220 can include one or more computing devices or servers that can perform various functions as described herein. The one or more client devices 220 can include any or all of the components and perform any or all of the functions of the computer system 100 described herein in conjunction with FIGS. 1A-1D. The client devices 220 can be, or can be similar to, the client devices 102 described herein above in conjunction with FIGS. 1A-1D.

Each client device 220 can include, but is not limited to, a television device, a mobile device, or another type of computing device. Each client device 220 can be implemented using hardware or a combination of software and hardware. Each client device 220 can include a display or display portion. The display can include a display portion of a television, a display portion of a computing device, a graphical user interface (GUI), or another type of interactive display (e.g., a touchscreen, a display, etc.) and one or more input/output (I/O) devices (e.g., a mouse, a keyboard, digital key pad). The display can include one or more portions, for example, to display multiple in-game events as described herein. The display can include a tough screen displaying an application, such as the gaming applications described herein. The display can include a border region (e.g., side border, top border, bottom border). In some implementations, the display can include a touch screen display, which can receive interactions from a player. The interactions can result in interaction data, which can be stored and transmitted by the processing circuitry of the client device 220. The interaction data can include, for example, interaction coordinates, an interaction type (e.g., click, swipe, scroll, tap, etc.), and an indication of an actionable object with which the interaction occurred. Each client device 220 can include an input device that couples or communicates with the display of each client device to enable a player to interact with and/or select one or more actionable objects as described herein. The display can enable interaction with one or more visual indications provided through the display of each mobile device 220, and responsive to an interaction (e.g., select, click-on, touch, hover), the client device 220 can generate an indication identifying a player input and/or selection of a wager, an in-game event, or an indication to participate in a bonus event, among others.

Each client device 220 can include a device identifier, which can be specific to each respective client device 220. The device identifier can include a script, code, label, or marker that identifies a particular client device 220. In some implementations, the device identifier can include a string or plurality of numbers, letters, characters or any combination numbers, letters, and characters. In some embodiments, each client device 220 can have a unique device identifier. Each client device 220 can include a client application, which can be a gaming application that communicates with the gaming system 205 to play games, and place wagers and side wagers, as described herein. The client application can include an application executing on each client device 220 or provided to the client device 220 by the gaming system. The application can include a web application, a server application, a resource, a desktop, or a file. In some implementations, the application can include a local application (e.g., local to a client device 220), hosted application, Software as a Service (SaaS) application, virtual application, mobile application, and other forms of content. In some implementations, the application can include or correspond to applications provided by remote servers or third party servers. In some implementations, the application can access the accounts 270, the play information 275, or the game instructions, stored and maintained at the database 215, and generate one or more actionable objects, such as the actionable objects described herein below in conjunction with FIGS. 3A-3L, to a player through a client device 220. Such actionable objects can include player-selectable hyperlinks, buttons, graphics, videos, images, or other application features that generate a signal that is processed by the application executing on the respective client device 220.

In embodiments, one or more client devices 220 can establish one or more communication sessions the gaming system 205 and the one or more client devices 220. The one or more communication sessions can each include a channel or connection between the gaming system 205 and the one or more client devices 220. The one or more communication systems can each include an application session (e.g., virtual application), an execution session, a desktop session, a hosted desktop session, a terminal services session, a browser session, a remote desktop session, a URL session and/or a remote application session. Each communication session can include encrypted and/or secure sessions, which can include an encrypted file, encrypted data or traffic. The client devices 220 can each use the communication session established with the gaming system 205 to carry out any of the functionalities described herein. For example, the application executing on a client device 220 can perform any of the client-side operations described herein, including displaying any of the user interfaces shown in FIGS. 3A-3L, or any other types of user interfaces described herein.

Each of the client devices 220 can be computing devices configured to communicate via the network 210 to access information resources, such as web pages via a web browser, or application resources via a native application executing on a client device 220. When accessing information resources, the client device can execute instructions (e.g., embedded in the native applications, in the information resources, etc.) that cause the client devices to display gaming application interfaces, such as the user interface described herein below in conjunction with FIGS. 3A-3L. The gaming application interfaces can be, for example, application interfaces that present different types of casino games, or other types of interactive video games. In general, video games include content (e.g., images, video, animations, graphics, audio, etc.) that is presented to a user via the input/output interfaces of a client device 220. The gaming application can display additional opportunities for side wagers, such as the side wagers described herein.

In response to interaction with user interface elements, the devices 220 can transmit information, such as account information (e.g., changing account parameters, changing login information, etc.), interaction information, selections of wager amounts, selections of gaming participation events, or other signals to the game system 205. In some implementations, a client device 220 can transmit a request to initiate a gaming session, and requests to place an additional side wager during a gaming session. The request can include, for example, a request to play a particular game (e.g., can include a game identifier, etc.). In some implementations, a client device 220 can transmit, during a play of a game, a signal to the gaming system 205 that indicates a desire to participate in an additional side wager for that game. The request can be a hypertext transfer protocol (HTTP or HTTPS) request message, a file transfer protocol message, an email message, a text message, or any other type of message that can be transmitted via the network 210.

In general, upon requesting a game, a client device 220 (or an application executing on the client device 220) can receive data relating to the requested game from the gaming system 205. The data relating to the requested game can include indications of a game state, which can be maintained by one or more of the components of the gaming system 205, as described herein. A game state can include one or more data structures that include any information related to a game state, such as current cards held by a user (e.g., in a blackjack or poker game, etc.), wager information, information about whether the user has placed any additional side wagers, the status or outcome of any side wagers on a gaming opportunity, or other game state data described herein. In some implementations, more than one hand for a play of a card game (e.g., a poker game, a blackjack game, a twenty one game, etc.) can be under the control of the player during a play of the card game. In such implementations, the game state information transmitted and received by the client application can include information relating to each hand under the control of the player, including any moves (e.g., hit, stay, bet, etc.), wagers, or side wagers associated with one or more of the hands.

The game state can include turn information (e.g., which user has the current turn, how many game turns have elapsed, etc.), or status information (e.g., the status or outcome of one or more wagers or side wagers placed by the player, etc.). In some implementations, the indications of the game state can be received as a play of the game occurs (e.g., as the play is processed by the gaming system 205 according to the game instructions, etc.). The indications of the game state can include instructions that cause the client device 220 to display one or more indicia, such as cards, dice, blackjack tables, poker tables, bingo cards, or other types of gaming indicia or user interface elements. Examples of cards displayed in a gaming application on a client device are shown in FIGS. 3A-3L. The client devices 220 can receive instructions from the gaming system can cause the client device 220 to display one or more actionable objects, such as the actionable objects described herein below in conjunction with FIGS. 3A-3L. In some implementations, the actionable objects can include information relating to each hand under the control of the player (e.g., when the player controls multiple hands simultaneously for a single play of the card game, as in the multi-hand card games shown in FIGS. 3A-3L).

As described herein, a client device 220 can receive one or more interactions with actionable objects presented on the display of the client device. Interactions can be tap interactions, click interactions, or other types of indications that a user is engaged with a particular user interface element. Upon detecting an interaction with a particular user interface element, the client device 220 can execute instructions (e.g., processor-readable code, a script, etc.) that cause the client device 220 to transmit an appropriate signal to the gaming system 205. A signal can include any information specified by the instructions associated with the particular actionable object with which the user interacted. The signals can include, for example, a request to engage in a specified game, a request to place a side wager on a play of a multi-hand card game, a request to advance the game state (e.g., hit/stay/split/double-down in blackjack, indications of cards to discard in poker, indications of which dice to roll in a dice game, indications that the user has stopped playing, etc.).

As described herein, a client device 220 and the gaming system 205 can exchange messages containing information that causes an interactive game to be displayed on the display of the client device 220. By interacting with the actionable objects presented on the display of the client device 220, the gaming system 205 can advance the state of the game, (e.g., for one or more hands controlled by the user, for hands controlled by a computer-controlled dealer, for one or more hands controlled by other players interacting with the gaming system 205, etc.) and transmit instructions to the client device that cause the client device change the user interface in accordance with the game state (e.g., display additional cards, display more/fewer dice, display more/fewer actionable objects providing additional functionality, display more/fewer fields that allow the user to enter user information, display game outcomes, display wager amounts, display bonus award opportunity information such as numbers generated by the gaming system 205, etc.). In some implementations, the client device 220 can receive content for presentation on the display of the client device 220 in a streaming arrangement (e.g., content is streamed from the gaming system 205 using a streaming protocol, etc.).

The database 215 can be a computer-readable memory that can store or maintain any of the information described herein. The database 215 can maintain one or more data structures, which may contain, index, or otherwise store each of the values, pluralities, sets, variables, vectors, numbers, or thresholds described herein. The database 215 can be accessed using one or more memory addresses, index values, or identifiers of any item, structure, or region maintained in the database 215. The database 215 can be accessed by the components of the gaming system 205, or any other computing device described herein, via the network 210. In some implementations, the database 215 can be internal to the gaming system 205. In some implementations, the database 215 can exist external to the gaming system 205, and may be accessed via the network 210. The database 215 can be distributed across many different computer systems or storage elements, and may be accessed via the network 210 or a suitable computer bus interface.

The gaming system 205 can store, in one or more regions of the memory of the gaming system 205, or in the database 215, the results of any or all computations, determinations, selections, identifications, generations, constructions, or calculations in one or more data structures indexed or identified with appropriate values. Any or all values stored in the database 215 may be accessed by any computing device described herein, such as the gaming system 205, to perform any of the functionalities or functions described herein. In some implementations, the database 215 can be similar to or include the storage 128 described herein above in conjunction with FIG. 1C. In some implementations, instead of being internal to the gaming system 205, the database 215 can form a part of the cloud computing system 260. In such implementations, the database 215 can be a distributed storage medium in a cloud computing system, and can be accessed by any of the components of the gaming system 205, by the one or more client devices 220 (e.g., via the user interface similar to that depicted in FIGS. 3A-3L, etc.), or any other computing devices described herein.

The database 215 can store one or more accounts 270 associated with a user of a client device 220. The account 270 can be a user profile that includes information about a user and information about one or more of the client devices 220 used to access the gaming system 205 using the account 270. For example, identifiers of an account can be used to access the functionality of the gaming system 205. The identifiers can include a username, a password, an e-mail address, a phone number, a personal identification number (PIN), a secret code-word, device identifiers for use in a two-factor authentication technique, among others. The account 270 can store information about wagers, games, and gaming events that are performed using the gaming system 205. The account 270 can store a credit balance, wager information or side wager information (e.g., an amount of a wager/side wager, a timestamp associated with a wager/side wager, information about gaming conditions or game state information that resulted in a side wager, a client device identifier of a client device that was used to place the wager/side wager, etc.). The account 270 can store information about a client device used to access the gaming system 205 such as an IP address, a MAC address, a GUID, an account name (e.g., the name of a user of the client device 220, etc.), device name, among others. In some implementations, an account 270 can be created by the gaming system 205 in response to an account creation request transmitted by a client device 220. The account creation request can include any of the account information described herein. The gaming system 205 can update the accounts 270 with additional wager information or additional side wager information as the information is received from a client device 220.

The database 215 can store or maintain play information 275 associated with each of the one or more accounts 270. The play information 275 can include game state information for games previously or currently played by a client device 220 having a corresponding account 270. In some implementations, a client device 220 accessing the gaming system 205 may not be associated with an account 270. In such implementations, the gaming system 205 can automatically create an account 270 using an identifier of the client device 220 provided by the client device 220. The play information 275 can include information about previous wagers, side wagers, hands, actions, interactions, or other data provided by the client device 220 during the play of a game provided by the gaming system 205. The play information 275 can maintain a game state of the game as it is being played. As described herein, the game state can include one or more data structures that include any information related to a game state, such as current cards held by a user (e.g., in a blackjack or poker game, etc.), wager information, information about whether the user has indicated a desire to participate in additional bonus award opportunities, or other game state data described herein.

The game state can include turn information, (e.g., which user has the current turn, how many game turns have elapsed, etc.). In some implementations, the indications of the game state can be received as a play of the game occurs (e.g., as the play is processed by the gaming system 205 according to the game instructions, etc.). The game state can include options that a user may take at each portion of a game, and any actions (e.g., interactions, pausing/waiting for a particular duration at stored timestamps, etc.) the client device 220 takes in response to said options. In some implementations, if multiple hands are being controlled by a player via the client device 220 for a single play of a card game (e.g., multiple hands for a single round of blackjack, etc.), the play information 275 can include game state information for each of the hands under control of the player. In addition, the play information 275 can include information relating to the conditions of various side wagers as described herein, such as, for example, whether multiple hands correspond to the various side wager conditions described herein.

The database 215 can store or maintain game instructions 280. The game instructions 280 can include instructions to play each of the games described herein (e.g., blackjack, poker, rummy, craps, sic bo, Klondike, any other game, etc.). The game instructions 280 can include one or more game events that occur in response to a particular game state. In short, the game instructions can include instructions to play a game from start to finish, by streaming gaming content to each of the client devices 220 that initiate play of a particular game. The game instructions 280 can be stored in one or more data structures that are indexed by a game name (e.g., blackjack, poker, rummy, craps, sic bo, Klondike, any other game, etc.). The game instructions 280 can be processor executable instructions that cause the gaming system 205 to provide one or more games to a client device 220 via a communication session.

In some implementations, the game instructions 280 can include artificial intelligence models (e.g., machine learning models, neural network, decision trees, ruled-based lookup table, etc.) that cause the gaming system 205 to play an opposing entity to a user of one of the games in the game instructions 280. For example, the artificial intelligence model can provide a simulated dealer in a blackjack game, a simulated user in a poker game, or other simulated users, dealers, or game entities. In some implementations, the gaming instructions 280 can include game instructions that allow a play of a game to progress with multiple hands. For example, in a multiple hand blackjack game, a player may play multiple blackjack hands against a single dealer hand for a single round, or play, of the blackjack game. The game instructions 280 can include instructions that accommodate multiple hands being controlled by a single player.

The game instructions 280 can include odds information, which can be stored as probability values of certain in-game events occurring. The odds information can be altered based on actions taken by the user, or the odds information can correspond to the likelihood of one or more particular expected outcomes (e.g., an expected value of user loss, an expected value of user win, etc.). The game instructions 280 can cause the game state in the play information 275 to be updated as a game is played by a client device 220. In some implementations, the game instructions can update the odds information in response to an indication (e.g., as stored in the play information 275, etc.) to participate in an additional bonus opportunity. In implementations where a player controls multiple hands, the game instructions 280 can update the game state in the play information 275 for each hand controlled by the player during the play of the game, for example, in response to player actions at the client device 220.

The game instructions 280 can include descriptions of game events or game criteria that can activate (e.g., provide, etc.) a side wager award. For example, in a blackjack game, a game event that provides a side wager award can be based on the number of hands controlled by a player during a single play of the blackjack game that have a score equal to a predetermined target hand value (e.g., the values of the cards in a user hand equal a target value, etc.). The target hand value can be determined by the gaming system 205, as described herein. In a poker game, the target hand value can be a predetermined poker rank (e.g., a high card, a pair, a two-pair, three of a kind, a straight, a flush, a full house, four of a kind, a straight flush, a royal flush, etc.). For a side wager condition in a poker game, the side wager condition can be based on a number of hands that have a predetermined poker rank corresponding to the side wager. In a rummy game, the game event can be, for example, one or more specified cards in a winning hand. In a dice game (e.g., craps, sic bo, Klondike, etc.), the game event can be a particular roll value (e.g., the values represented by dice after rolling the dice, etc.). The game instructions 280 can specify the conditions under which the user can be awarded with awards according to a side wager when the side wager condition is met (e.g., at game termination, on user win, on user loss, a predetermined number of hands having a score corresponding to a value, etc.). Each of the components of the gaming system 205 can access, update, or modify the accounts 270, the play information 275, or the game instructions 280, to carry out functionalities described herein.

Referring now to the operations of the gaming system 205, the wager receiver 230 can receive one or more wagers from a player of a card game via the client device 220. Each wager can correspond to a respective hand of a play of card game, where the play of the card game includes the player having control of multiple hands. The wager receiver 230 can receive a side wager to participate in an additional award opportunity that is independent of the outcome of the play of the card game. The wagers for each of the multiple hands of the play of the card game (or other games, as described herein), and the side wager, can be received in one or more messages received from the application executing on the client device 220. The message, or request, can indicate that a player intends to play a game provided by the gaming server 205. The message can include an indication of an account 270 with which to use for the functionalities related to the game (e.g., placing wagers using earned credits, purchasing additional credits, etc.). The message can be a request to play a game, and can include an identifier of a particular game to play. In some implementations, the wager receiver 230 can provide the client device 220 with instructions to display one or more games to play, allowing the player to select a game from the list. In response to an interaction indicating a selection, the client device 220 can transmit a signal identifying a game to the gaming server 205. Using the game selection, the gaming server can communicate a user interface that prompts the player to select a wager amount for each of a number of simultaneous hands for the game, and a side wager for the additional award opportunity (e.g., the interfaces shown in FIGS. 3A-3L).

The selected game can be, for example, a card based game, which can include (but is not limited to) poker, blackjack, or rummy. In some implementations, the game can be a dice-based game, which can include (but is not limited to) a game of craps, sic bo, or Klondike. The games provided by the gaming server 205 can be multiple play games, which allow a player to play multiple hands simultaneously against a dealer (e.g., such as the four hands shown in FIGS. 3A-3L, etc.). In some implementations, the wager receiver 230 can receive, as a part of the request to play the selected game, a request to participate in an additional award opportunity corresponding to a target additional award condition. For example, the wager receiver 230 can present one or more actionable objects on the player interface of the client device, that when actuated, allow a player to customize a side wager, and then cause the client device to transmit a signal to the gaming server that provides the side wager for the play of the selected game. A play of a game can be a single "round" or play-through of a game to a termination condition (e.g., a condition after which the player has won or lost the wagers for each simultaneous hand, etc.). The wager amounts provided by the client device can be a specified amount of credits, such as 1, 5, 25, 100, 500, or 1000 credits. In some implementations, the player can specify a custom number or fractional number of credits used in the game for each hand and the side wager. Once the wagers (including side wagers) have been selected using the user interface, the client device 220 can transmit a request to place the wagers (and the side wager) for the play of the game.

Figure 3A:
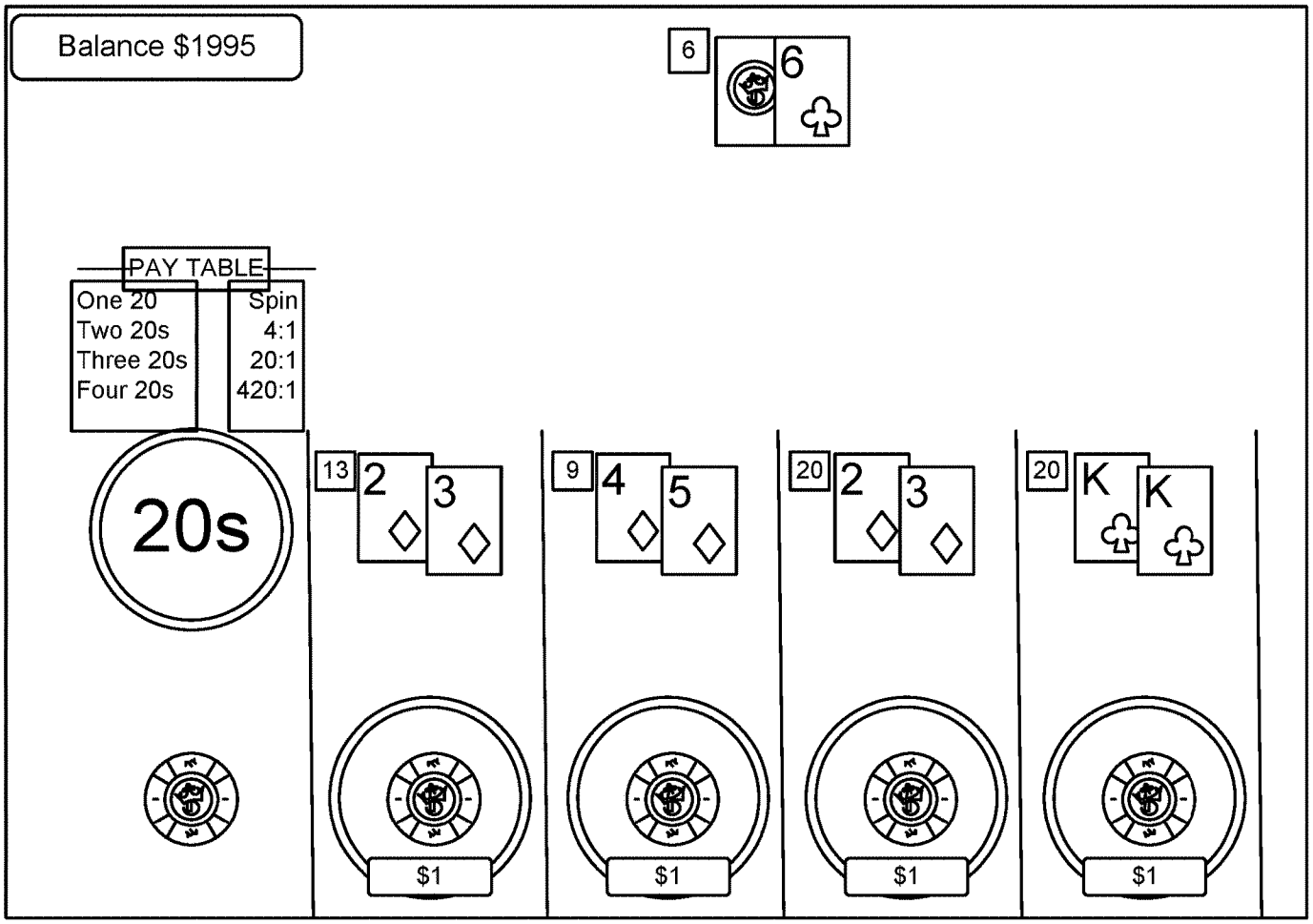
FIGS. 3A and 3B illustrate hands of a card game satisfying a first side wager condition, in accordance with one or more implementations.

The hand provider 235 can provide one or more hands corresponding to each of the wagers received by the wager. At the start of the play of the selected game, the hand provider 235 can randomly select cards from a virtual deck of cards using a randomized card selection technique, to generate a number of hands for the player corresponding to the rules of the selected game. Furthering the example implementation shown in FIGS. 3A-3L, the number of hands generated and provided to the player is four. After generating each hand for the player for the play of the game, the hand provider 235 can provide a message (e.g., via a network communication) to the client device 220 that includes the generated hands. In addition, the hand provider 235 can generate a hand for a virtual adversary (e.g., a dealer in the example above), and transmit information indicating the visible portions of the hand (e.g., the face-up card in the case of blackjack, etc.) to the application executing on the client device 220, as shown in FIG. 3A.

The side condition determiner 240 can determine a number of the hands provided by the hand provider 235 that satisfy a side wager condition. The side condition determiner 240 can compare each of the initially dealt hands to a side wager condition. The side wager condition can be a predetermined condition, provided to the player, that if met provides additional award opportunities for the player. In the example provided in FIGS. 3A-3L, the side wager condition is whether an initially dealt hand has a score that is equal to '20'. In blackjack, each card is assigned a numerical value. The overall score of a hand is equal to the sum of the numerical values of each card in the hand. Because the player is dealt four hands, there are four opportunities to satisfy the award condition (e.g., one for each hand). The side condition determiner 240 can calculate the total score for each initial hand dealt to the player, and compare the total score to the award condition (e.g., the score of '20'). If the score for the initial hand matches the score for the award condition (e.g., the side wager condition), the side condition determiner 240 increments a counter. The counter tracks the number of hands dealt to the player that satisfy the award condition. Once the number of hands that satisfy the side wager condition is calculated, the components of the gaming server 205 can calculate an award for the player based on the number of hands that satisfy the side wager condition. It should be understood that a side wager condition of "a hand having a score that matches a predetermined value," is used for example purposes only, and other side wager conditions are possible. In addition, in other game types, such as poker, the side wager condition can be based on hand rank. For example, in a multiple-hand poker game, the side wager condition can be the number of hands that have a predetermined poker rank (or greater than a predetermined poker rank, etc.).

Once the side condition determiner 240 has determined the number of hands that satisfy the side wager condition, the credit manager 245 can calculate a first additional award amount according to the side wager condition. The first additional award can be calculated in a variety of ways. In one example, the number of hands that satisfy the side wager condition can be used in a lookup table to determine a potential payout. In the example shown in FIG. 3B, only one hand matches the side award condition, and the lookup table indicates the side award is determined based on a "spin." A spin can be a random selection generated by the credit manager 245 that provides a random payout ratio (e.g., a push, a 1:1 payout, a 3:1 payout, other payout ratios, etc.). The random "spin" selection process can be accompanied by a corresponding animation displayed at the client device.

Figure 3B:
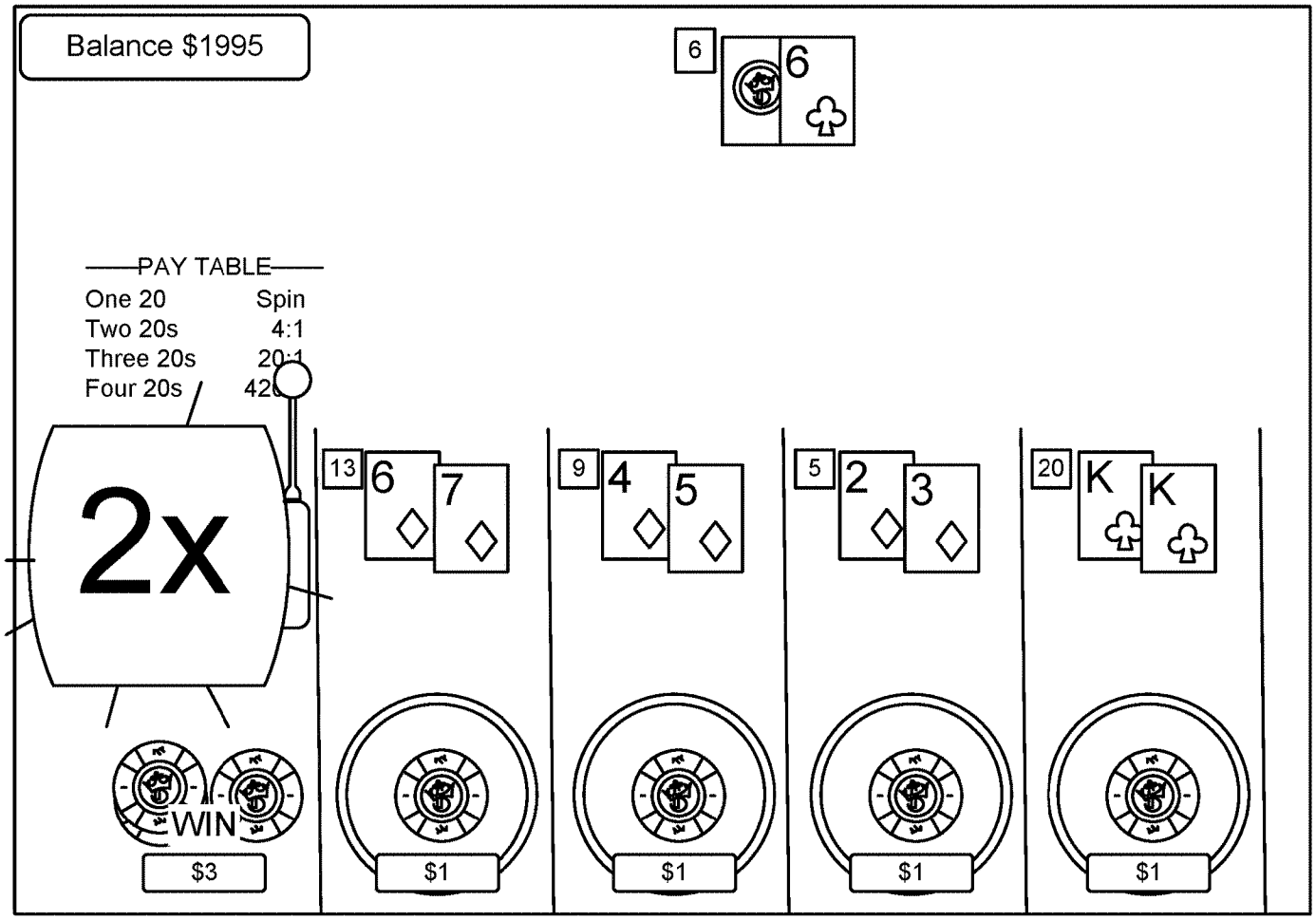

In the example shown in FIG. 3B, the random spin generated a "2×" payout, or 2:1 payout odds. However, it should be understood that other randomly selected award payouts are possible. For example, as shown in FIG. 3A, the payout ratio for the side wager if there are two hands that satisfy the side wager condition is 4:1, the payout ratio for the side wager if there are three hands that satisfy the side wager condition is 20:1, and the payout ratio for the side wager if there are four hands that satisfy the side wager condition is 420:1. Other payout ratios, amounts, or awards can be stored in a lookup table and accessed by the gaming server. The first additional award amount can be computed based on the value accessed in the lookup table. So, if a 4:1 payout odds is selected from the lookup table (as in FIG. 3F), the payout will be 5 credits for every one credit wagered as part of the side wager. In some implementations, an account 270 of the player (e.g., indicated in the request to play the card game, etc.) can be credited by the first award amount in response to calculating the first award amount, rather than following the completion of the play of the card game. In this way, the player may place a wager amount prior to finishing the play of the card game (e.g., blackjack, poker, etc.) using the credit amounts provided in the first additional award amount.

The game award determiner 250 can monitor the play of the card game, for example, according to each of the multiple hands controlled by the player. Following the calculation of the side award amount, the game award determiner 250 can monitor play of the game according to each of the hands dealt to the player. Because the player is playing four separate hands against a dealer, the player can select multiple buttons or actionable objects to "hit," "stay," "double down," or "stand," in the case of the blackjack. Other in-game actions are possible for other games, such as poker, rummy, or a dice game. The game award determiner 250 can determine game start and game termination conditions for each hand. In implementations where the game is a blackjack game, the game award determiner 250 can monitor a total value of a player hand in response to player hit selections. For example, during the blackjack game, the game award determiner 250 can access game instructions 280 to conduct the blackjack game according to the rules of blackjack.

When the player requests a hit option, an additional card can be drawn into the player's hand (e.g., the selected hand of the many hands the player is dealt, where the card is provided, for example, via random selection by the hand provider 235, etc.), which can be presented as part of the player hand in the user interface. The player can play each hand individually until the player selects the "stand" option for that hand, indicating the player has completed their play for that hand. Upon such selection, the game award determiner 250 can select the next hand until the player has either selected "stand" for each hand or "busted" (e.g., exceeded 21) on each hand. The game award determiner 250 can monitor each player hand to determine whether the player has busted, or exceeded a hand value (e.g., twenty one in blackjack, etc.). To do so, the game award determiner 250 can identify each card included in the player hand, and determine a total score for the hand by summing each numerical value assigned to each card. Based on the value of the cards in the player hand, the game award determiner 250 can determine a game termination condition (e.g., the total hand value exceeds the predetermined value, etc.). The game award determiner 250 can also determine the game termination condition in a blackjack game if the player interacts with the "stand" user interface object, indicating the player intends to hold the current hand against the dealer according to the rules of blackjack.

Likewise, in other game types, such as a poker game, the game award determiner 250 can monitor the player hand by determining the rank of the player hand. The rank of the player hand can include any of the standard poker ranks, including a high card, a pair, a two-pair, three of a kind, a straight, a flush, a full house, four of a kind, a straight flush, or a royal flush. Other poker games, with more or fewer cards, can include additional ranks, each of which can be specified in the game instructions 280 for the particular poker game. The game award determiner 250 can monitor the rank of the cards in the player hand by comparing the cards to one or more poker ranks specified in the game instructions. The game award determiner 250 can assign the highest rank to the player hand (e.g., three of a kind instead of a pair, etc.). The game award determiner 250 can monitor events of the game (e.g., actions taken by the player, etc.), and store identifiers of those events in play information. In some implementation, the game award determiner 250 can update the game state in accordance with the game instructions. As above, once a player has indicated that they are finished playing one of the multiple hands (e.g., via player selection, etc.), or has otherwise completed play of the hand, the client device 220 (or in some implementations, the game award determiner 250) can select the next hand for the player to engage with (e.g., make selections of moves according to the game rules) until each hand has been played to a termination point.

The game award determiner 250 can determine that the play (e.g., round, hand, etc.) of a game is complete by detecting the game termination condition in accordance with the game instructions 280 for all playable hands dealt to the player at the client device 220, as described herein. In some implementations, the game award determiner 250 can detect the game is complete by comparing the game state in the play information 275 for the game (e.g., maintained by the gaming server in the database 215) to a game termination state (e.g., that all hands are complete or at a termination state, as described above). If the game state matches the termination state, the game is determined to be complete. If the game award determiner 250 determines that the play of the game is complete, the gaming system can proceed to determine an award amount for each hand. Otherwise, the game award determiner 250 can continue to monitor and coordinate the play of the card game, as described herein.

The game award determiner 250 can determine an award amount for each hand according to the game instructions 280, once all of the multiple hands dealt to the player are determined to be in a game termination state. To do so, the game award determiner 250 can evaluate each of the completed (e.g., after the gameplay has completed) hands of the player in accordance with the game instructions 280. For example, in blackjack, the overall score of each hand can be compared to the overall score of the generated dealer hand. If the hand exceeds the dealer hand, the gaming server can compute a payout for that hand according to a payout rules of the game (e.g., stored, for example, in a lookup table in the game instructions 280, etc.) and a respective wager associated with the hand. The payout values shown in FIGS. 3A-3L for winning hands are calculated as double the wager amount (e.g., the player wins back twice the amount they wager). So, if the player wagers $1, the payout amount is $2, and so on. The game award determiner 250 can calculate the winning amount for each hand sequentially, or in parallel. In some implementations, hands that are "push" hands, or hands that match the score of the dealer, do not award a payout but instead simply return the amount wagered to the player. So, if the player wagers $1 on a push hand, the player would receive a $1 payout, and "break even." A hand that does not satisfy a win condition or a push condition (e.g., a hand having a score that is less than the score of the dealer hand, etc.) does not award a payout (subject to other conditions in the game instructions 280), and the player loses their wager for those hands. Once an award amount has been calculated for each hand provided to the player, the credit manager 245 can credit an account 270 of the player according to the winning amounts.

Once an award amount has been determined for each of the hands, the credit manager 245 can adjust (e.g., increase) a credit balance according to the total award amount. The credit manager 245 can cause the credit balance to increase based on the computed side wager award and the award amounts calculated for each hand. In some implementations, the credit manager 245 can cause the credit balance to increase by a sum of the side wager award amount and the award amount calculated for each hand. If the side wager award amount is zero (e.g., the bonus award condition was not met, etc.), the credit manager 245 can increase the credit balance only by the award amounts for each winning hand. In implementations where the side wager award was credited to the player prior to the completion of the game, the credit manager 245 can cause the credit balance of the player to increase by only the award amounts of each winning hand following completion of the play of the card game. The credit manager 245 can store the updated credit amount in an account 270 corresponding to the player accessing the game via the client device. In some implementations, the credit manager 245 can store a record of the award amount(s) won, in association with one or more timestamps corresponding to the time the award amount(s) were won, in the account 270 of the player.

Referring now to FIG. 3A, illustrated are initially dealt hands of a card game (here, blackjack) satisfying a first side wager condition, in accordance with one or more implementations. The hands of the card game, as shown, were dealt following the player (sometimes referred to herein as a player) placing a side wager (sometimes referred to herein as an additional wager) on a side wager condition. In this example, the "pay table" indicates that the side wager condition awards an additional award amount to a player of the game based on the number of initially dealt hands that have the score of '20'. In addition, the player is engaging in four blackjack hands simultaneously, each with their own corresponding wager amount chosen by the player (here, for simplicity, each wager is illustrated as $1, but other wagers are possible). Although not shown in FIG. 3A, the wager amount for the additional wager already placed by the player is $1.

In the example illustrated in FIG. 3A, only one hand (the rightmost hand) has a score of twenty (e.g., two kings, where each king has a numerical score of 10). The other hands, from left-to-right as indicated, have the scores of 13, 9 and 5, respectively. As shown in the pay table, the award for one 20 is a spin. A spin allows for a randomly generated payout amount, which is randomly selected by the gaming server. The results of the spin can be shown as a graphical animation, for example. As shown in FIG. 3B, the spin result landed on "2×," which indicates that the payout odds for the $1 side wager is 2:1, making the additional award amount for the side wager $3 (e.g., two-times the wager amount is awarded as profit). Note that because the additional wager condition is triggered based on initially dealt hand values, the payout for the side wager is determined before the play of the game (e.g., each of the blackjack hands against the dealer) has been completed.

Figure 3C:
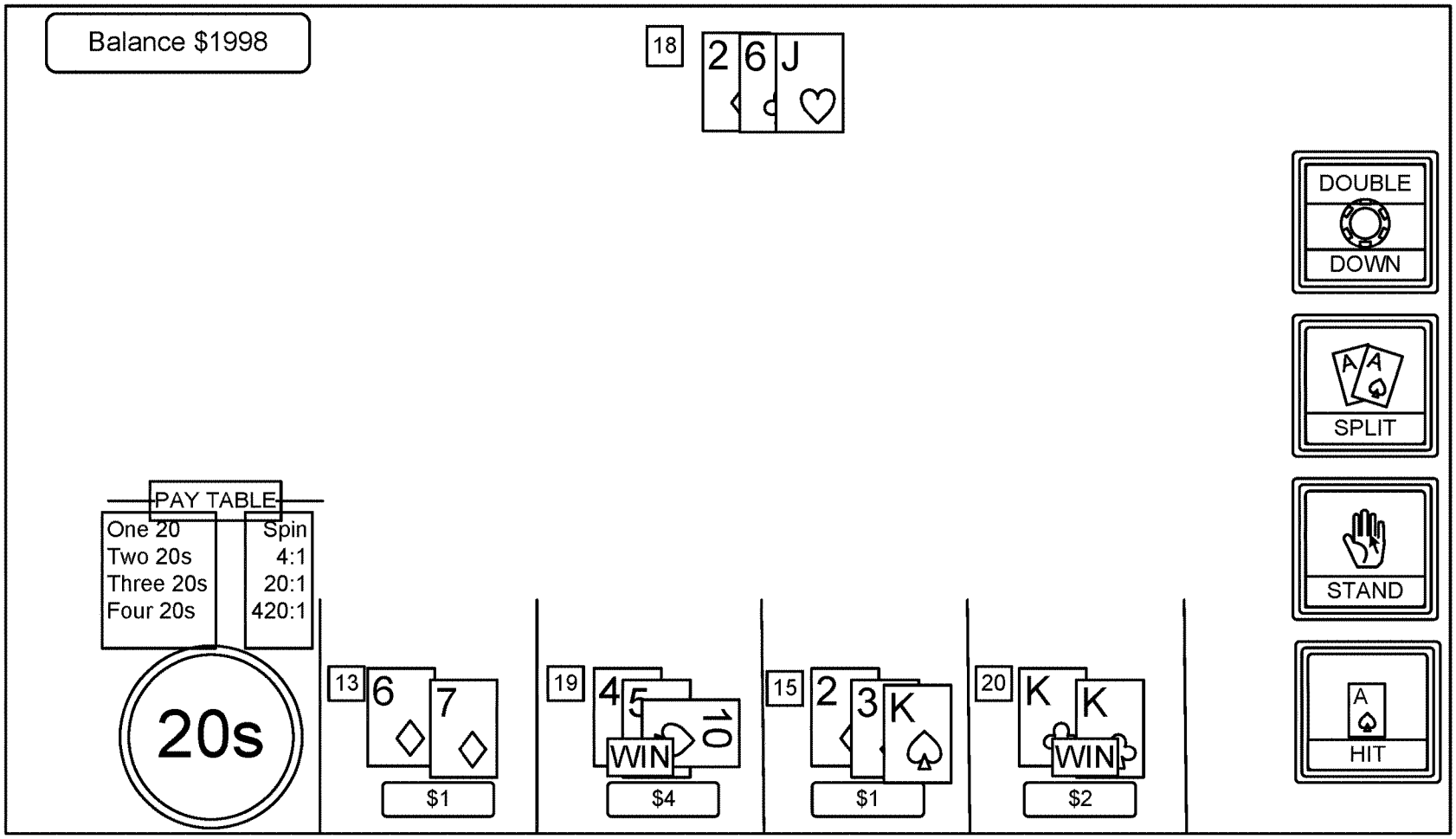
FIGS. 3C and 3D illustrate the hands depicted in FIGS. 3A and 3B played to completion, and a total payout amount including the side award amount, in accordance with one or more implementations.
Figure 3D:
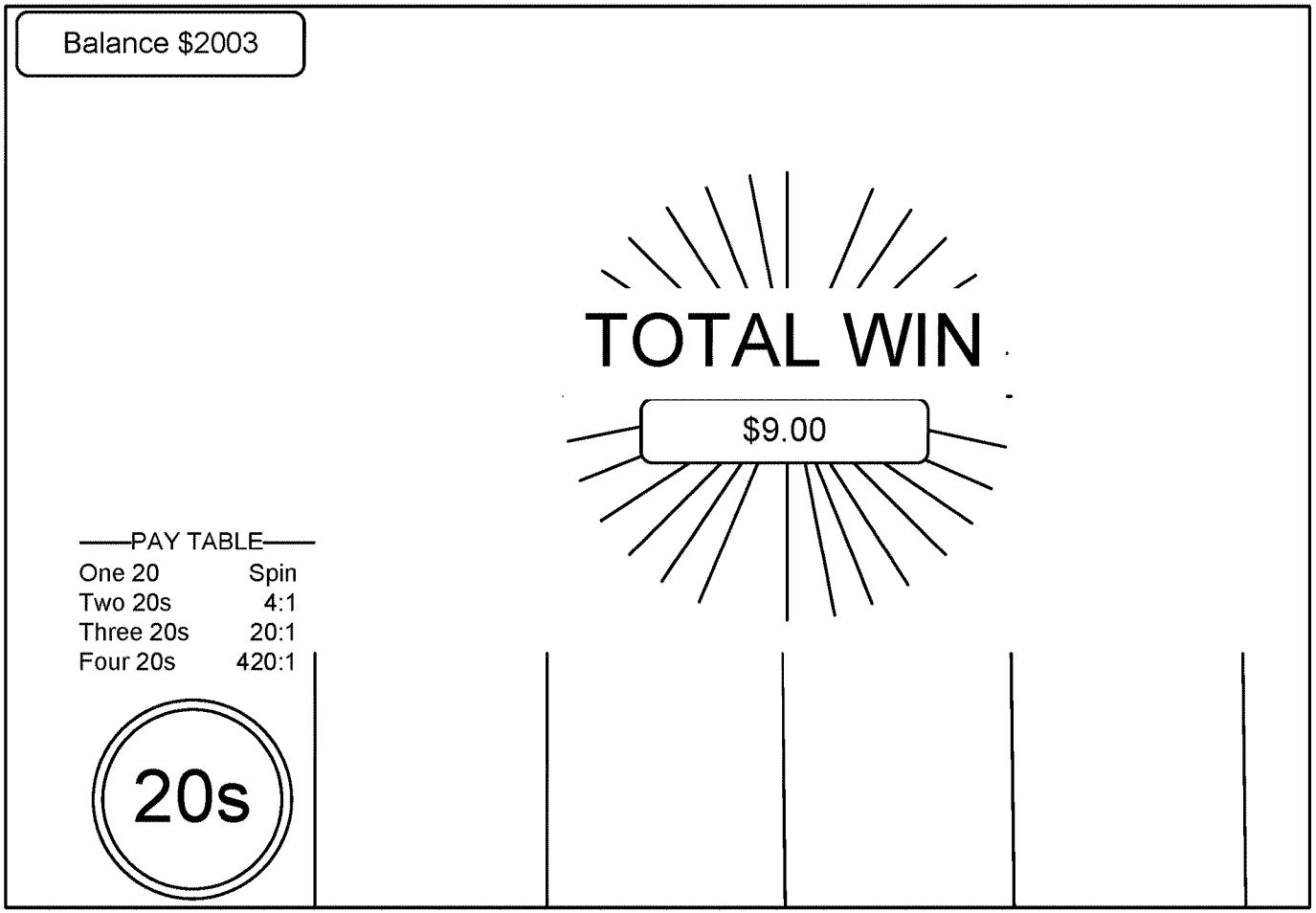

Referring now to FIGS. 3C and 3D, illustrated are the hands depicted in FIGS. 3A and 3B played to completion. As shown in FIG. 3C, each of the hands in FIGS. 3A and 3B have been played to completion following the determination of the side wager award. The dealer hand (e.g., generated by the gaming server using random card generation techniques) has a final value of 18. As shown, after the player has chosen one or more of "double down," "split," "stand," or "hit" for each of the four hands dealt to the player (e.g., any number of times to complete the play of the hand according to the rules of blackjack), the final scores of the hands are equal to 13, 19, 15, and 20. Because the hands having scores of 19 and 20 are greater than the dealer hand, these are winning hands, while the hands having scores that are less than the dealer hand are losing hands (e.g., no payout will be provided). Winning hands are awarded according to the payout rules of the blackjack game. Because the player selected "double down" for the hand having the score of 19, the player doubled their wager to $2 and therefore will receive a $4 payout on that hand, as shown (e.g., twice the wagered amount). Likewise, the hand having the wager of $1 (no double down) and the final score of 20 will award the player with a payout of $2 (e.g., twice the wager amount). Referring now to FIG. 3D, the final payout of all hands, including the side wager, is shown as $9. This is because the side wager award provides a payout of $3, and the two winning hands shown in FIG. 3C providing $2 and $4, totaling $9. Once the final winning amount has been presented to the player, an additional game opportunity can be provided to the player (e.g., a "Play Again" button, etc.). Additional side wager award conditions, and total payout amounts, are shown in FIGS. 3E-3L. The final wager amount can be added to the total amount of credits for the player by the gaming server (e.g., shown as the balance amount in the top left corner). The total amount of credits can be stored in one or more data structures in the memory of the gaming server, and can correspond to an account of the player.

Figure 3E:
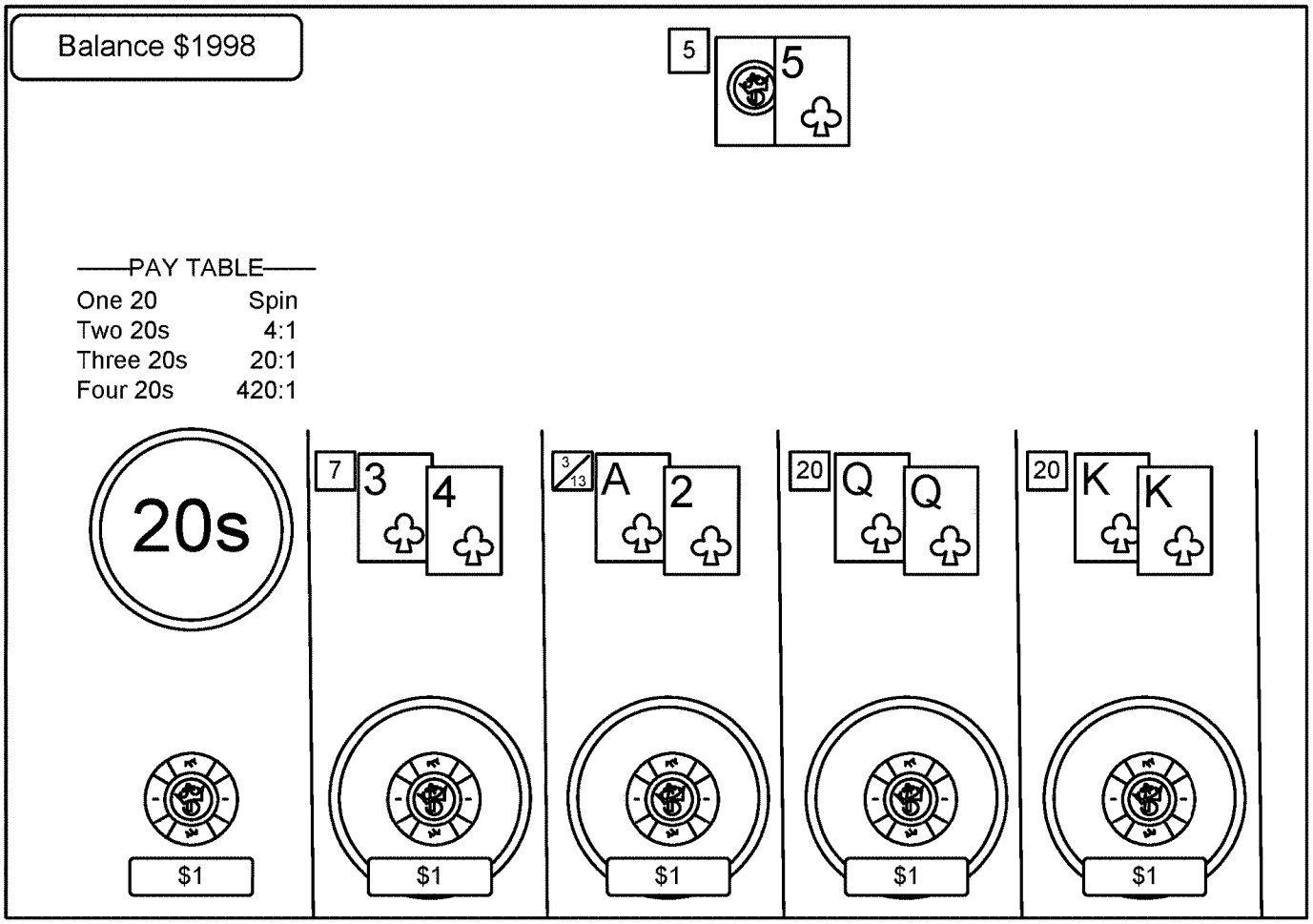
FIGS. 3E and 3F illustrate hands of a card game satisfying a second side wager condition, in accordance with one or more implementations.
Figure 3F:
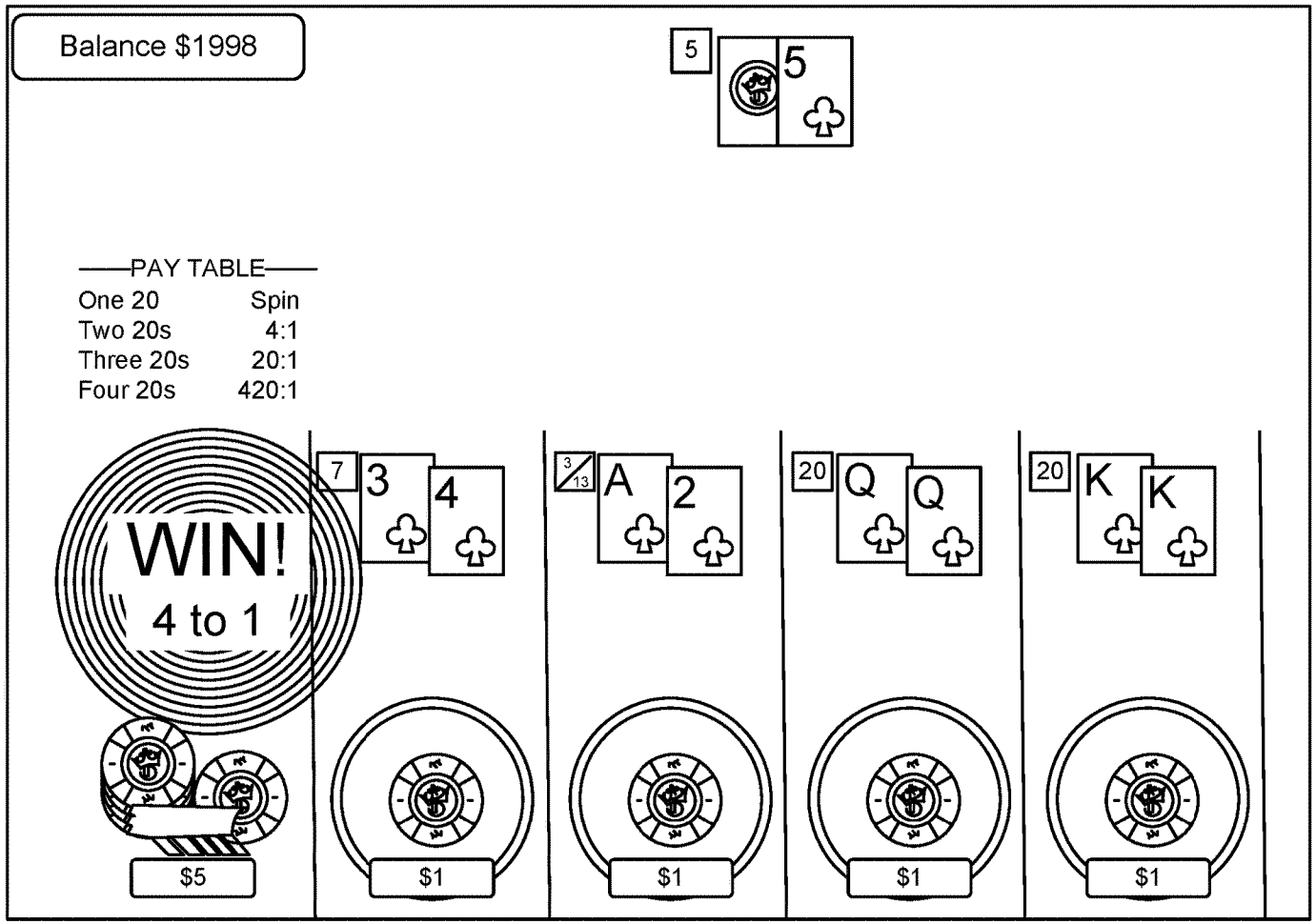

Referring now to FIGS. 3E and 3F, illustrated are initially dealt hands of a blackjack card game satisfying a second side wager condition (e.g., two initially dealt hands having the target score of '20'). As shown in FIG. 3E, the two rightmost hands have the score of '20'. The pay table on the left side of FIG. 3E indicates the payout for two initially dealt hands having a score of '20' results in a 4:1 payout of the side wager. In this example, like the example described above in FIGS. 3A and 3B, the initial side wager was $1. Therefore, as shown in FIG. 3F, the overall additional payout amount is $5 (e.g., $4 profit for each $1 wagered). As above, following the payout according to the side wager, the card game can be played for each dealt hand according to the rules of blackjack until a final payout is calculated by the gaming server, as shown in FIGS. 3G and 3H.

Figure 3G:
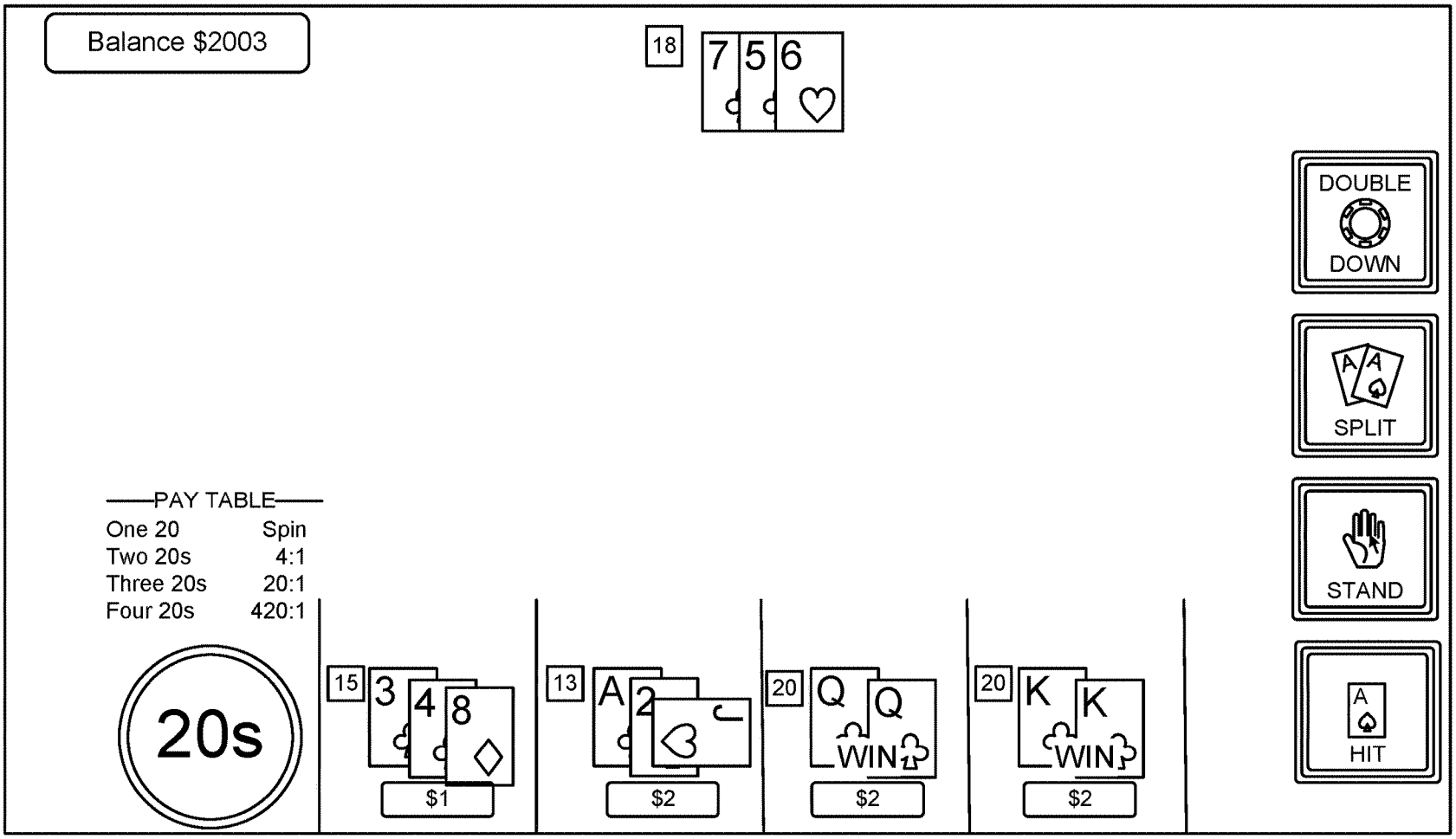
FIGS. 3G and 3H illustrate the hands depicted in FIGS. 3E and 3F played to completion, and a total payout amount including the side award amount, in accordance with one or more implementations.
Figure 3H:
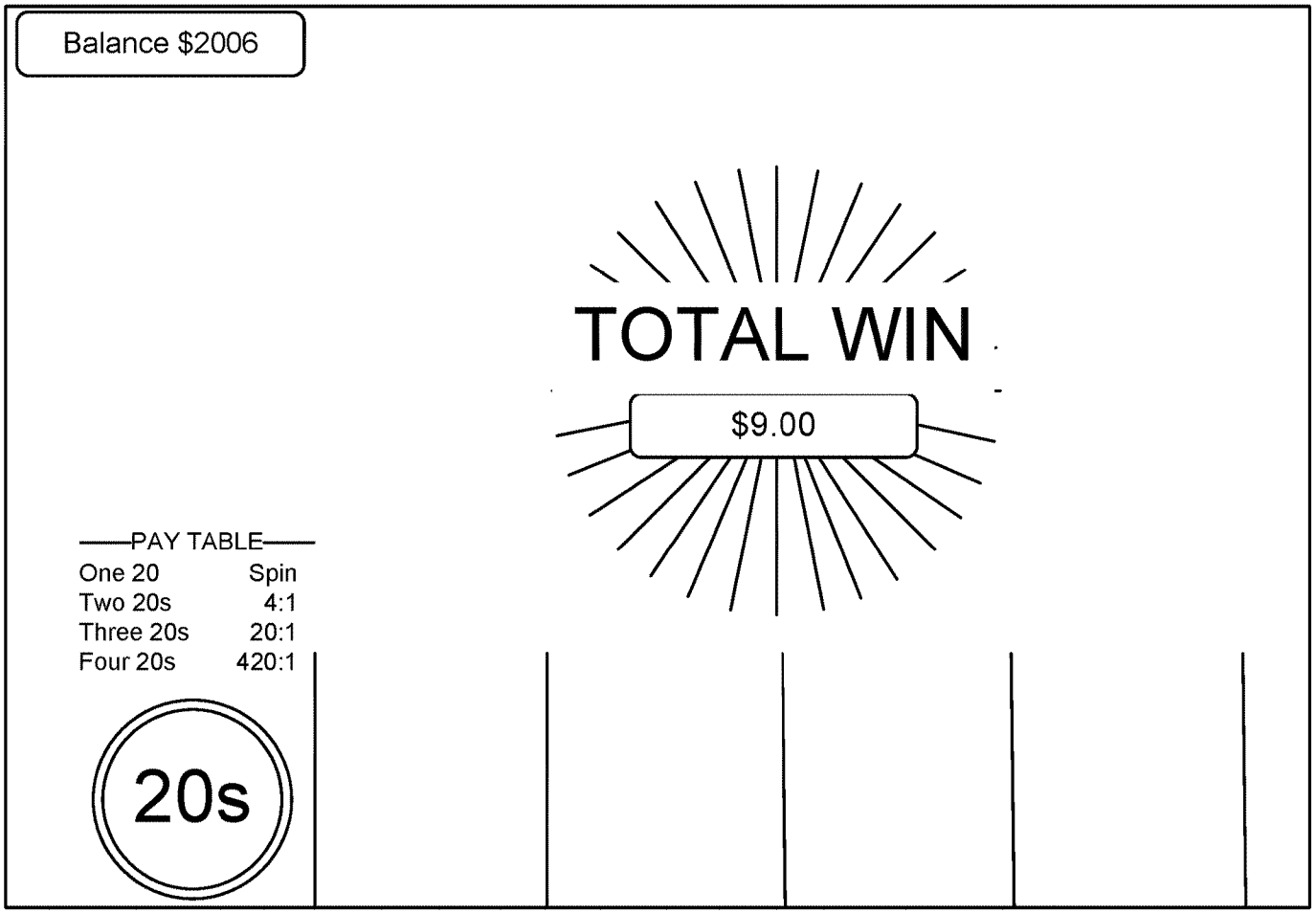

Referring now to FIGS. 3G and 3H, illustrated are the initially dealt hands depicted in FIGS. 3E and 3F played to completion. As shown in FIG. 3G, each of the hands in FIGS. 3E and 3F have been played to completion (e.g., by interaction with player-selectable elements, etc.), following the determination of the side wager award. The dealer hand (e.g., generated by the gaming server using random card generation techniques) again has a final value of 18. As shown, after the player has chosen one or more of "double down," "split," "stand," or "hit" for each of the four hands dealt to the player (e.g., any number of times according to the rules of blackjack to complete play of each hand), the final scores of the hands are equal to 15, 13, 20, and 20. Because the hands each having scores of 20 are greater than the dealer hand, these are winning hands, while the hands having scores that are less than the dealer hand are losing hands (e.g., no payout will be provided).

Winning hands are awarded according to the payout rules of the blackjack game. Because, in this example, the player selected "double down" for the hand having the score of 13 (e.g., a "soft 13"), the player doubled their wager to $2. However, because this hand is not a winning hand, the player has lost this wager amount. The two hands having the final score of 20 each have a wager amount of $1 (no double down) and are therefore each awarded with a payout of $2, as shown. Referring now to FIG. 3H, the final payout of all hands, including the side wager award, is shown as $9. This is because the side wager award provides $5, and the two winning hands shown in FIG. 3G each provide $2, which totals $9. Once the final winning amount has been presented to the player, an additional game opportunity can be provided to the player (e.g., a "Play Again" button, etc.). Additional side wager award conditions, and total payout amounts, are shown in FIGS. 3E-3L. The final wager amount can be added to the total amount of credits for the player by the gaming server (e.g., shown as the balance amount in the top left corner), for example, by adjusting a credit balance of an account of the player.

Figure 3I:
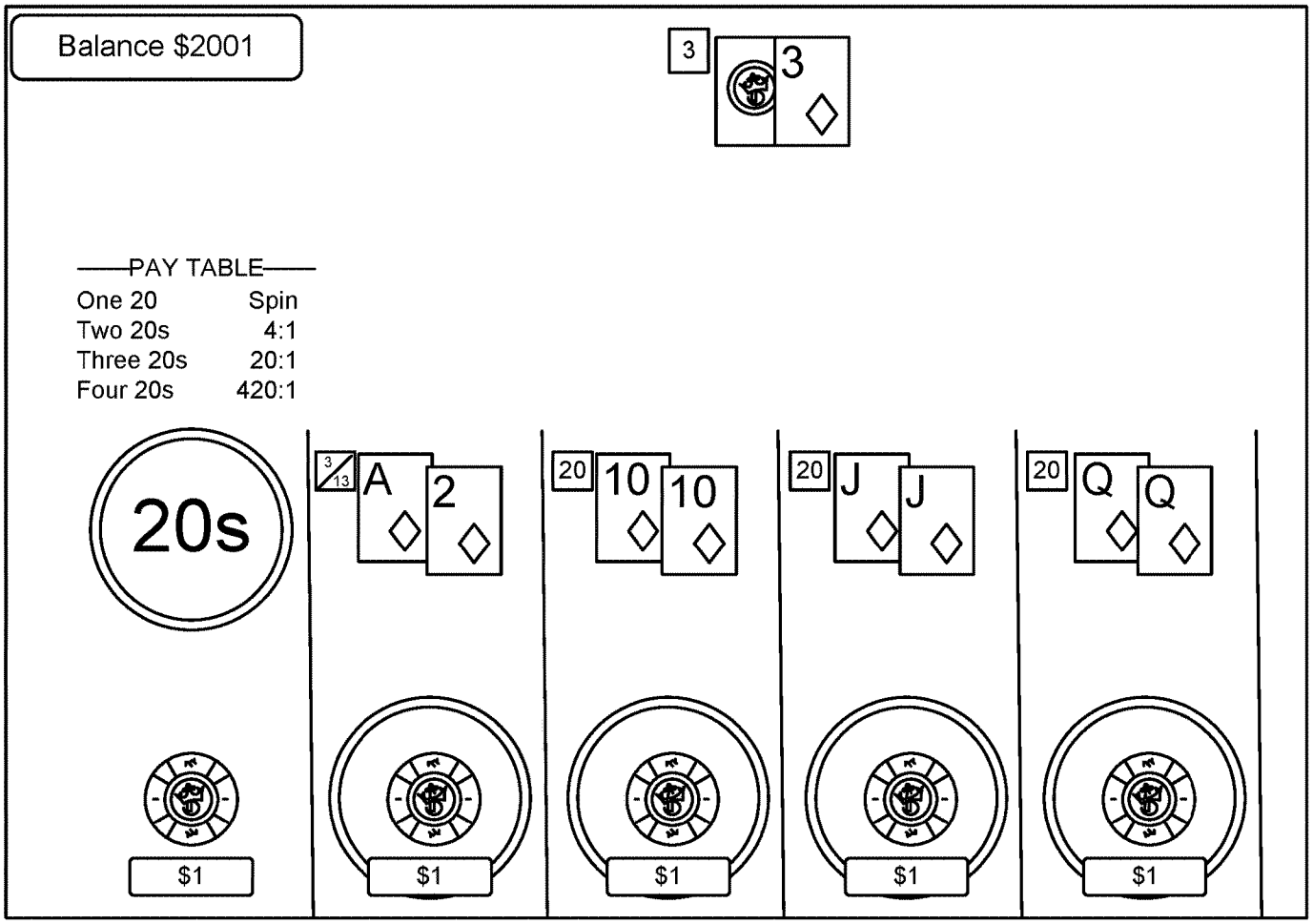
FIGS. 3I and 3J illustrate hands of a card game satisfying a third side wager condition, in accordance with one or more implementations.
Figure 3J:
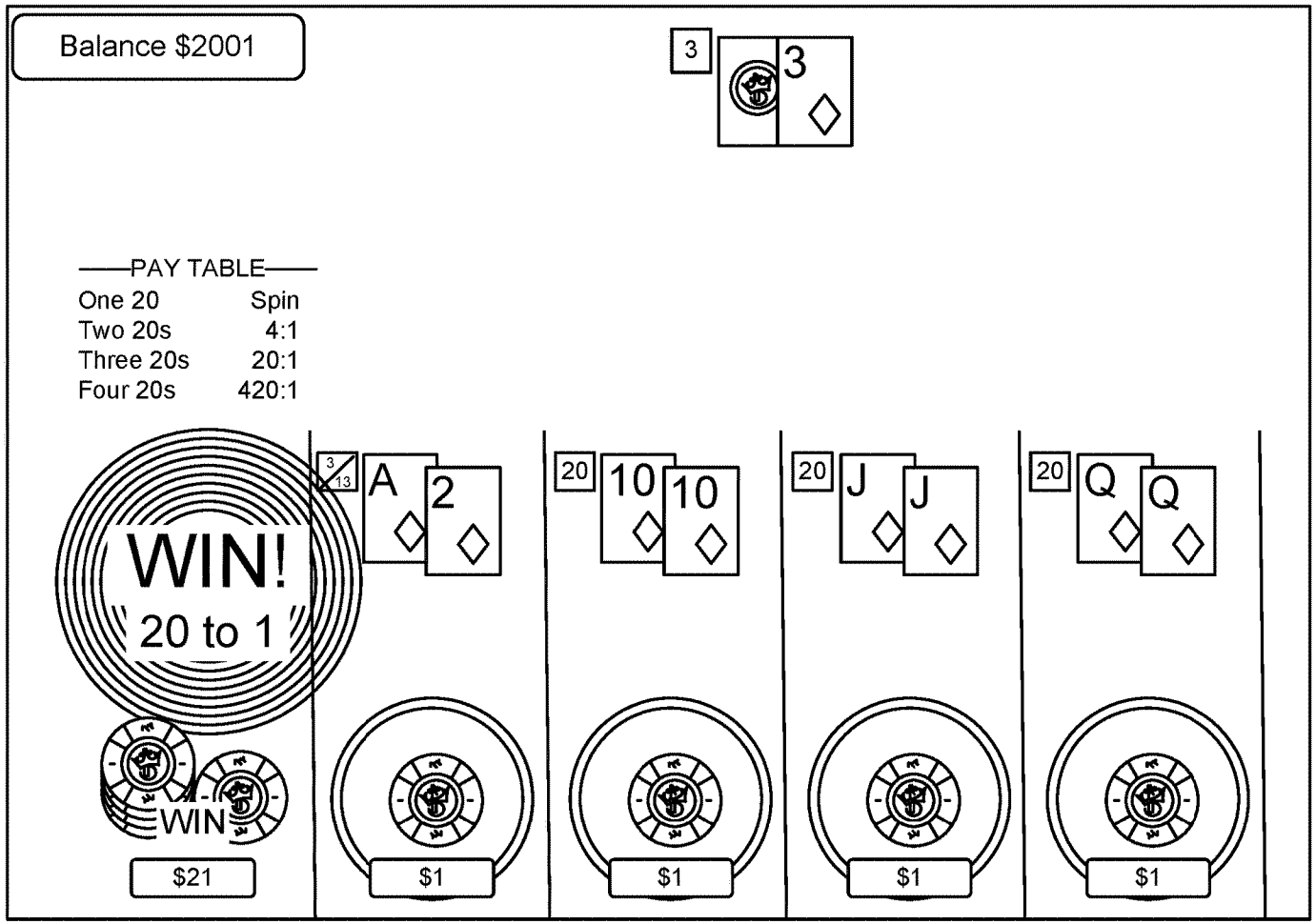

FIGS. 3I and 3J illustrate hands of a card game satisfying a third side wager condition (e.g., three initially dealt hands having the target score of '20'). As shown in FIG. 3I, the three rightmost initially dealt hands have the score of '20'. The pay table on the left side of FIG. 3I indicates the payout for three initially dealt hands having a score of '20' results in a 20:1 payout of the side wager. In this example, like the case described above in FIGS. 3A and 3B, the initial side wager was $1. Therefore, as shown in FIG. 3J, the overall payout amount for the side wager is $21. As above, following the payout according to the side wager, the card game can be played according to the rules of blackjack until a final payout is calculated by the gaming server, as shown in FIGS. 3K and 3L.

Figure 3K:
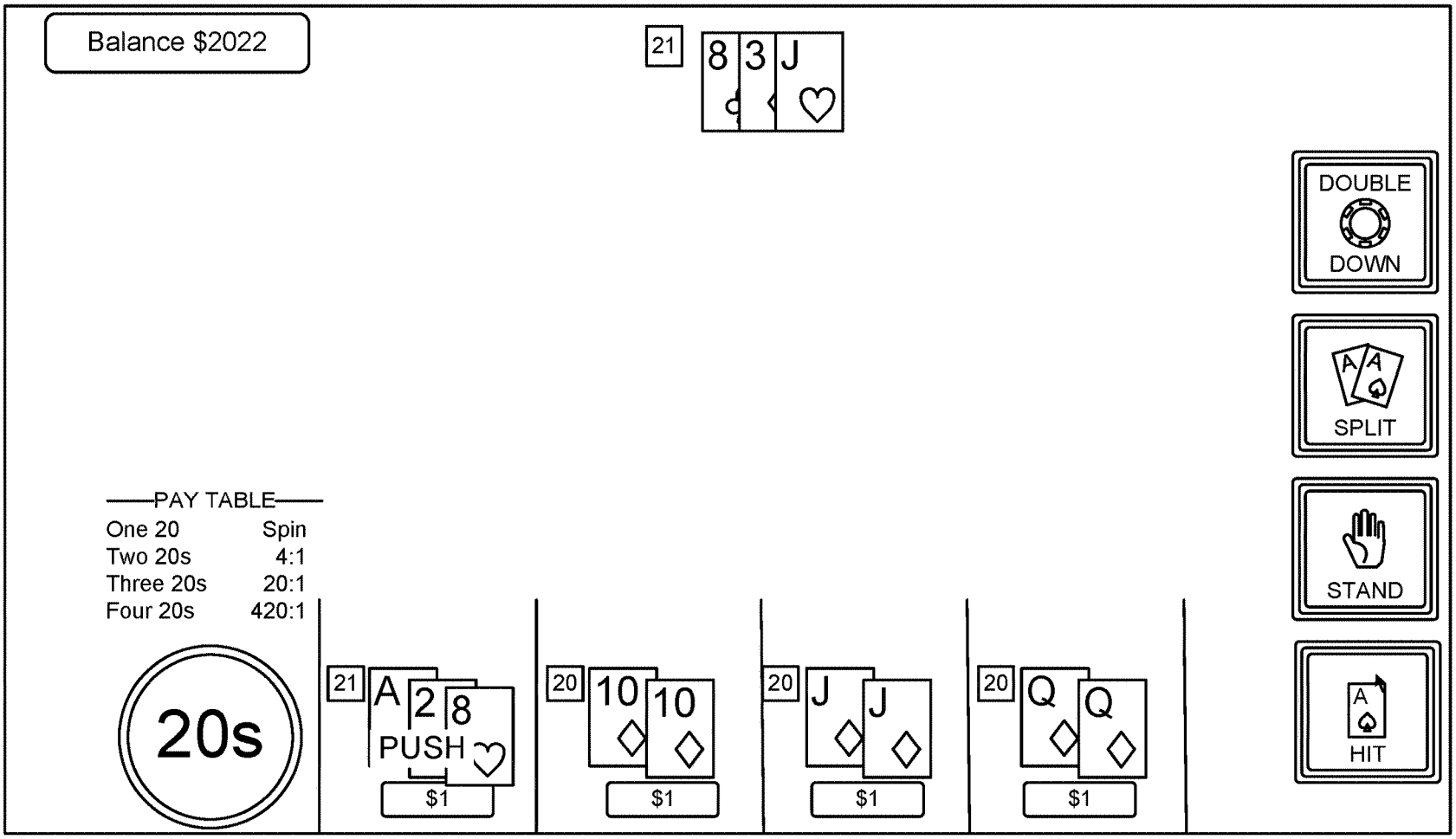
FIGS. 3K and 3L illustrate the hands depicted in FIGS. 3I and 3J played to completion, and a total payout amount including the side award amount, in accordance with one or more implementations.
Figure 3L:
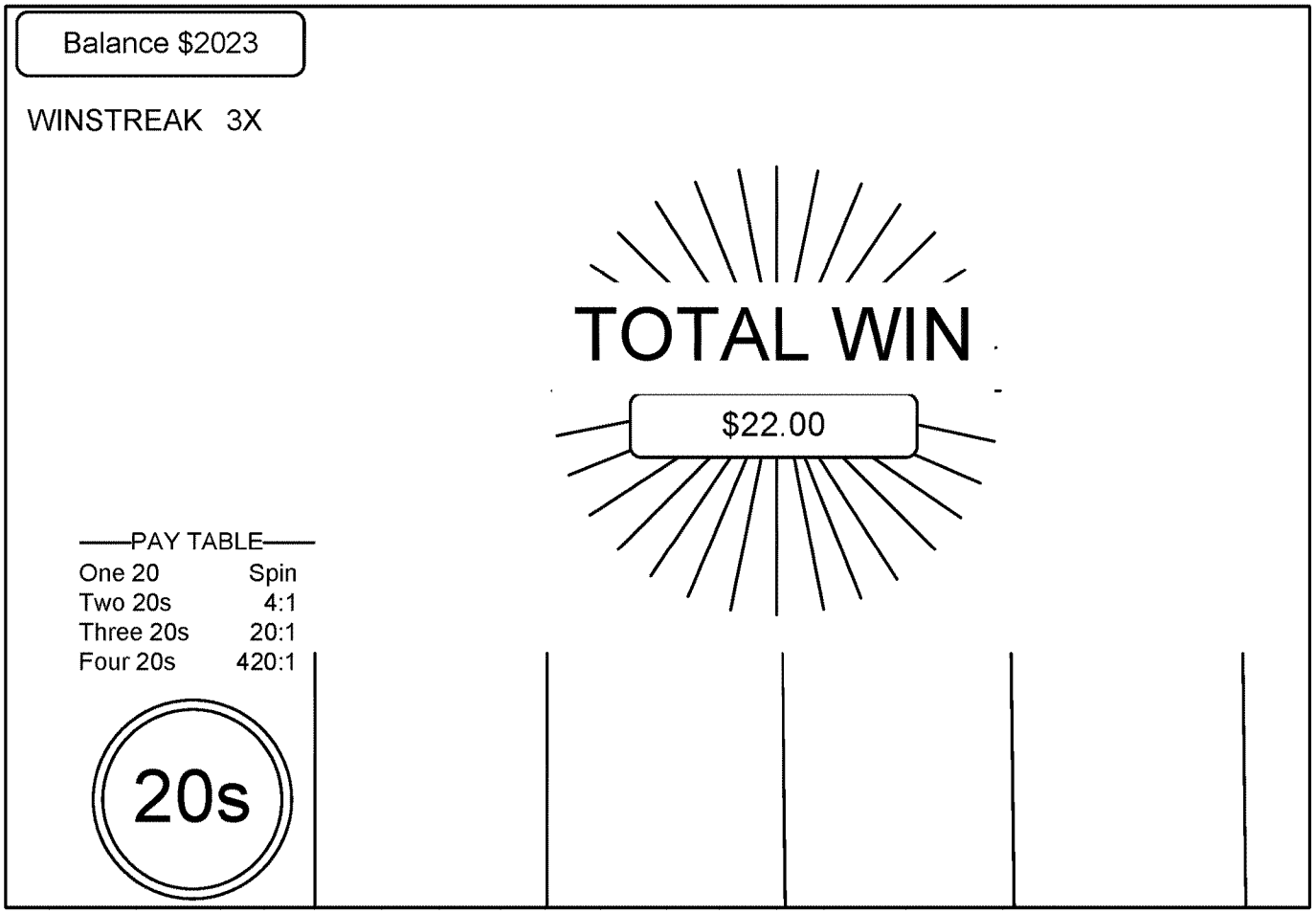

Referring now to FIGS. 3K and 3L, illustrated the initially dealt hands depicted in FIGS. 3H and 3I played to completion, and FIG. 3L shows a total payout amount including the side award amount. As shown in FIG. 3K, each of the hands in FIGS. 3I and 3J have been played to completion (e.g., by interaction with player-selectable elements, etc.), following the determination of the side wager award. The dealer hand (e.g., generated by the gaming server using random card generation techniques) has a final value of 21. As shown, after the player has chosen one or more of "double down," "split," "stand," or "hit" for each of the four hands dealt to the player (e.g., any number of times according to the rules of blackjack), the final scores of the hands are equal to 21, 20, 20, and 20. Because the hands that each have scores of 20 are lower than the dealer hand, these are losing hands, while the hand having a score that is equal to the dealer hand score (here, 21) is a "push."

Because there are no winning hands resulting from this play, and only one "push" hand, the payout for the "push" hand and the three other losing hands is only $1. This means the total award amount, as shown in FIG. 3L, is $22. Here, the side wager award provides $21, and the push hand shown in FIG. 3K provides just $1, totaling $22. Once the final winning amount has been presented to the player, an additional game opportunity can be provided to the player (e.g., a "Play Again" button, etc.). The final wager amount can be added to the total amount of credits for the player by the gaming server (e.g., shown as the balance amount in the top left corner). The functionality of the gaming server is described in greater detail herein in connection with FIG. 4.

Figure 4:
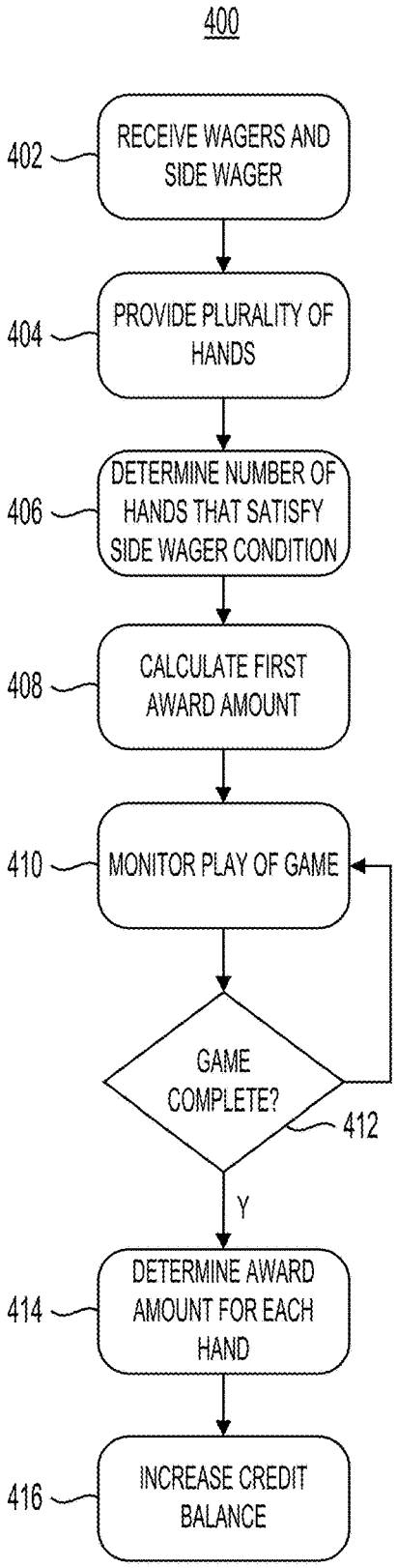
FIG. 4 illustrates an example flow diagram of a method for providing gaming system functionalities with additional award opportunities, in accordance with one or more implementations.

Referring now to FIG. 4, depicted is an illustrative flow diagram of a method 400 for providing games having additional award opportunities. The method 400 can be executed, performed, or otherwise carried out by a gaming server or a gaming system. A gaming server can be remote to one to one or more client devices, and communicate with the one or more client devices via a computer network. In some implementations, the operations of method 400 can be performed by a standalone gaming device (e.g., without communicating with a gaming server to perform the method steps). In brief overview of the method 400, the gaming server can receive a plurality of wagers each corresponding to a respective hand of a play of card game, and a side wager to participate in an additional award opportunity that is independent of the outcome of the play of the card game (STEP 402), provide a plurality of hands corresponding to the plurality of wagers (STEP 404), determine a number of the hands that satisfy a side wager condition (STEP 406), calculate a first additional award amount (STEP 408), monitor the play of the card game (STEP 410), determine whether the play of the game is complete (STEP 412), determine an award amount for each hand (STEP 414), and increase a credit balance according to the total award amount (STEP 416).

In further detail of the method 400, the gaming server can receive a plurality of wagers each corresponding to a respective hand of a play of card game, and a side wager to participate in an additional award opportunity that is independent of the outcome of the play of the card game (STEP 402). The wagers for each of the hands, and the side wager, can be received in one or more messages received from a client device. The message, or request, can indicate that a player intends to play a game provided by the gaming server. The message can include an indication of an account with which to use for the functionalities related to the game (e.g., placing wagers using earned credits, purchasing additional credits, etc.). The message can be a request to play a game, and can include an identifier of a particular game to play. In some implementations, the gaming server can provide the client device with instructions to display one or more games to play, allowing the player to select a game from the list. In response to an interaction indicating a selection, the client device can transmit a signal identifying a game. Using the game selection, the gaming server can communicate a user interface that prompts the player to select a wager amount for each of a number of simultaneous hands for the game, and a side wager for the additional award opportunity (e.g., the interfaces shown in FIGS. 3A-3L).

The selected game can be, for example, a card based game, which can include (but is not limited to) poker, blackjack, or rummy. In some implementations, the game can be a dice-based game, which can include (but is not limited to) a game of craps, sic bo, or Klondike. The games provided by the gaming server can be multiple play games, which allow a player to play multiple hands simultaneously against a dealer (e.g., such as the four hands shown in FIGS. 3A-3L, etc.). In some implementations, the gaming server can receive, as a part of the request to play the selected game, a request to participate in an additional award opportunity corresponding to a target additional award condition. For example, the gaming server can present one or more actionable objects on the player interface of the client device, that when actuated, allow a player to customize a side wager, and then cause the client device to transmit a signal to the gaming server that provides the side wager for the play of the selected game. A play of a game can be a single "round" or play-through of a game to a termination condition (e.g., a condition after which the player has won or lost the wagers for each simultaneous hand, etc.). The wager amounts provided by the client device can be a specified amount of credits, such as 1, 5, 25, 100, 500, or 1000 credits. In some implementations, the player can specify a custom number or fractional number of credits used in the game for each hand and the side wager. Once the wagers (including side wagers) have been selected using the user interface, the client device can transmit a request to place the wagers (and the side wager) for the play of the game.

The gaming server can provide a plurality of hands corresponding to the plurality of wagers (STEP 404). At the start of the play of the selected game, the gaming server can randomly select cards from a virtual deck of cards using a randomized card selection technique, to generate a number of hands for the player corresponding to the rules of the selected game. Furthering the example implementation shown in FIGS. 3A-3L, the number of hands generated and provided to the player is four. After generating each hand for the player for the play of the game, the gaming server can provide a message (e.g., via a network communication) to the client device that includes the generated hands. In addition, the gaming server may at this time generate a hand for a virtual adversary (e.g., a dealer in the example above), and transmit information indicating the visible portions of the hand (e.g., the face-up card in the case of blackjack, etc.) to the player, as shown in FIG. 3A.

The gaming server can determine a number of the hands that satisfy a side wager condition (STEP 406). The gaming server can compare each of the initially dealt hands to a side wager condition. The side wager condition can be a predetermined condition, provided to the player, that if met provides additional award opportunities for the player. In the example provided in FIGS. 3A-3L, the side wager condition is whether an initially dealt hand has a score that is equal to '20'. In blackjack, each card is assigned a numerical value. The overall score of a hand is equal to the sum of the numerical values of each card in the hand. Because the player is dealt four hands, there are four opportunities to satisfy the award condition (e.g., one for each hand). The gaming server can calculate the total score for each initial hand dealt to the player, and compare the total score to the award condition (e.g., the score of '20'). If the score for the initial hand matches the score for the award condition (e.g., the side wager condition), the gaming server increments a counter. The counter tracks the number of hands dealt to the player that satisfy the award condition. Once the number of hands that satisfy the side wager condition is calculated, the gaming server can execute STEP 408. It should be understood that a side wager condition of "a hand having a score that matches a predetermined value," is used for example purposes only, and other side wager conditions are possible.

The gaming server can calculate a first additional award amount (STEP 408). The first additional award can be calculated in a variety of ways. In one example, the number of hands that satisfy the side wager condition can be used in a lookup table to determine a potential payout. In the example shown in FIG. 3B, only one hand matches the side award condition, and the lookup table indicates the side award is determined based on a "spin." A spin is a random selection generated by the gaming server that provides a random payout ratio (e.g., a push, a 1:1 payout, a 3:1 payout, other payout ratios, etc.). The random "spin" selection process can be accompanied by a corresponding animation displayed at the client device. In the example shown in FIG. 3B, the random spin generated a "2×" payout, or 2:1 payout odds. However, it should be understood that other randomly selected award payouts are possible. For example, as shown in FIG. 3A, the payout ratio for the side wager if there are two hands that satisfy the side wager condition is 4:1, the payout ratio for the side wager if there are three hands that satisfy the side wager condition is 20:1, and the payout ratio for the side wager if there are four hands that satisfy the side wager condition is 420:1. Other payout ratios, amounts, or awards can be stored in a lookup table and accessed by the gaming server. The first additional award amount can be computed based on the value accessed in the lookup table. So, if a 4:1 payout odds is selected from the lookup table (as in FIG. 3F), the payout will be 5 credits for every one credit wagered as part of the side wager. In some implementations, an account of the player (e.g., indicated in the request to play the card game, etc.) can be credited the first award amount in response to calculating the first award amount, rather than following the completion of the play of the card game.

The gaming server can monitor the play of the card game (STEP 410). Following the calculation of the side award amount, the gaming server can monitor play of the game according to each of the hands dealt to the player. Because the player is playing four separate hands against a dealer, the player can select multiple buttons or actionable objects to "hit," "stay," "double down," or "stand," in the case of the blackjack. Other in-game actions are possible for other games, such as poker, rummy, or a dice game. The gaming server can determine game start and game termination conditions for each hand. In implementations where the game is a blackjack game, the gaming server can monitor a total value of a player hand in response to player hit selections. For example, during the blackjack game, the gaming server can access game instructions to conduct the blackjack game according to the rules of blackjack. When the player requests a hit option, an additional card can be drawn into the player's hand (e.g., the selected hand of the many hands the player is dealt, etc.), which can be presented as part of the player hand in the user interface. The player can play each hand individually until the player selects the "stand" option for that hand, indicating the player has completed their play for that hand. Upon such selection, the gaming server can select the next hand until the player has either selected "stand" for each hand or "busted" (e.g., exceeded 21) on each hand. The gaming server can monitor each player hand to determine whether the player has busted, or exceeded a hand value (e.g., twenty one in blackjack, etc.). To do so, the gaming server can identify each card included in the player hand, and determine a total score for the hand by summing each numerical value assigned to each card. Based on the value of the cards in the player hand, the gaming server can determine a game termination condition (e.g., the total hand value exceeds the predetermined value, etc.). The gaming server can also determine the game termination condition in a blackjack game if the player interacts with the "stand" user interface object, indicating the player intends to hold the current hand against the dealer according to the rules of blackjack.

Likewise, in other game types, such as a poker game, the gaming server can monitor the player hand by determining the rank of the player hand. The rank of the player hand can include any of the standard poker ranks, including a high card, a pair, a two-pair, three of a kind, a straight, a flush, a full house, four of a kind, a straight flush, or a royal flush. Other poker games, with more or fewer cards, can include additional ranks, each of which can be specified in the game instructions for the particular poker game. The gaming server can monitor the rank of the cards in the player hand by comparing the cards to one or more poker ranks specified in the game instructions. The gaming server can assign the highest rank to the player hand (e.g., three of a kind instead of a pair, etc.). The gaming server can monitor events of the game (e.g., actions taken by the player, etc.), and store identifiers of those events in play information. In some implementation, the gaming server can update the game state in accordance with the game instructions. As above, once a player has indicated that they are finished playing one of the multiple hands (e.g., via player selection, etc.), or has otherwise completed play of the hand, the client device (or in some implementations, the gaming server) can select the next hand for the player to engage with (e.g., make selections of moves according to the game rules) until each hand has been played to a termination point.

The gaming server can determine whether the play of the game is complete (STEP 412). The gaming system can determine that the play (e.g., round, hand, etc.) of a game is complete by detecting a game termination condition in accordance with the game rules for all playable hands dealt to the player at the client device, as described in STEP 408. In some implementations, the gaming system can detect the game is complete by comparing the game state for the game (e.g., maintained by the gaming server) to a game termination state (e.g., that all hands are complete or at a termination state, as described above). If the game state matches the termination state, the game can be complete. If the gaming system determines that the play of the game is complete, the gaming system can proceed to execute STEP 414 of the method 400. If the gaming system determines that the play of the game is not yet complete, the gaming system can continue to monitor the game in STEP 410 of the method 400.

The gaming server can determine an award amount for each hand (STEP 414). To do so, the gaming server can evaluate each of the completed (e.g., after the gameplay has completed) hands of the player in accordance with the gameplay rules. For example, in blackjack, the overall score of each hand can be compared to the overall score of the generated dealer hand. If the hand exceeds the dealer hand, the gaming server can compute a payout for that hand according to a payout rules of the game and a respective wager associated with the hand. The payout values shown in FIGS. 3A-3L for winning hands are calculated as double the wager amount (e.g., the player wins back twice the amount they wager). So, if the player wagers $1, the payout amount is $2, and so on. The gaming server can calculate the winning amount for each hand sequentially, or in parallel. In general, hands that are "push" hands, or hands that match the score of the dealer, do not award a payout but instead simply return the amount wagered to the player. So, if the player wagers $1 on a push hand, the player would receive a $1 payout, and "break even." A hand that does not satisfy a win condition or a push condition (e.g., a hand having a score that is less than the score of the dealer hand, etc.) does not award a payout, and the player simply loses their wager for those hands. Once an award amount has been calculated for each hand provided to the player, the gaming server can execute STEP 416.

The gaming server can adjust (e.g., increase) a credit balance according to the total award amount (STEP 416). The gaming server can cause the credit balance to increase based on the computed side wager award and the award amounts calculated for each hand. In some implementations, the gaming server can cause the credit balance to increase by a sum of the side wager award amount and the award amount calculated for each hand. If the side wager award amount is zero (e.g., the bonus award condition was not met, etc.), the gaming server can increase the credit balance only by the award amounts for each winning hand. In implementations where the side wager award was credited to the player prior to the completion of the game, the gaming server can cause the credit balance of the player to increase by only the award amounts of each winning hand following completion of the play of the card game. The gaming server can store the updated credit amount in an account corresponding to the player accessing the game via the client device. In some implementations, the gaming server can store a record of the award amount(s) won, in association with one or more timestamps corresponding to the time the award amount(s) were won, in the account of the player.

Implementations of the subject matter and the operations described in this specification can be implemented in digital electronic circuitry, or in computer software embodied on a tangible medium, firmware, or hardware, including the structures disclosed in this specification and their structural equivalents, or in combinations of one or more of them. Implementations of the subject matter described in this specification can be implemented as one or more computer programs, e.g., one or more components of computer program instructions, encoded on computer storage medium for execution by, or to control the operation of, data processing apparatus. The program instructions can be encoded on an artificially-generated propagated signal, e.g., a machine-generated electrical, optical, or electromagnetic signal that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of these. Moreover, while a computer storage medium is not a propagated signal, a computer storage medium can include a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The terms "data processing apparatus", "data processing system", "client device", "computing platform", "computing device", or "device" encompasses all kinds of apparatus, devices, and machines for processing data, including by way of example a programmable processor, a computer, a system on a chip, or multiple ones, or combinations of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of these. The apparatus and execution environment can realize various different computing model infrastructures, such as web services, distributed computing, and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatuses can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The elements of a computer include a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), for example. Devices suitable for storing computer program instructions and data include all forms of non-volatile memory, media, and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a player, implementations of the subject matter described in this specification can be implemented on a computer having a display device, e.g., a CRT (cathode ray tube), plasma, or LCD (liquid crystal display) monitor, for displaying information to the player and a keyboard and a pointing device, e.g., a mouse or a trackball, by which the player can provide input to the computer. Other kinds of devices can be used to provide for interaction with a player as well; for example, feedback provided to the player can include any form of sensory feedback, e.g., visual feedback, auditory feedback, or tactile feedback; and input from the player can be received in any form, including acoustic, speech, or tactile input. In addition, a computer can interact with a player by sending documents to and receiving documents from a device that is used by the player; for example, by sending web pages to a web browser on a player's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a player can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system such as the gaming system described herein can include clients and servers. For example, the gaming system can include one or more servers in one or more data centers or server farms. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving input from a player interacting with the client device). Data generated at the client device (e.g., a result of an interaction, computation, or any other event or computation) can be received from the client device at the server, and vice-versa.

While this specification contains many specific implementation details, these should not be construed as limitations on the scope of any inventions or of what may be claimed, but rather as descriptions of features specific to particular implementations of the systems and methods described herein. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In some cases, the actions recited in the claims can be performed in a different order and still achieve desirable results. In addition, the processes depicted in the accompanying figures do not necessarily require the particular order shown, or sequential order, to achieve desirable results.

In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. For example, the gaming system could be a single module, a logic device having one or more processing modules, one or more servers, or part of a search engine.

Having now described some illustrative implementations, it is apparent that the foregoing is illustrative and not limiting, having been presented by way of example. In particular, although many of the examples presented herein involve specific combinations of method acts or system elements, those acts and those elements may be combined in other ways to accomplish the same objectives. Acts, elements and features discussed only in connection with one implementation are not intended to be excluded from a similar role in other implementations.

The phraseology and terminology used herein is for the purpose of description and should not be regarded as limiting. The use of "including," "comprising," "having," "containing," "involving," "characterized by," "characterized in that," and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations, elements, or acts of the systems and methods herein referred to in the singular may also embrace implementations including a plurality of these elements; and any references in plural to any implementation, element, or act herein may also embrace implementations including only a single element. References in the singular or plural form are not intended to limit the presently disclosed systems or methods, their components, acts, or elements to single or plural configurations. References to any act or element being based on any information, act or element may include implementations where the act or element is based at least in part on any information, act, or element.

Any implementation disclosed herein may be combined with any other implementation, and references to "an implementation," "some implementations," "an alternate implementation," "various implementation," "one implementation," or the like are not necessarily mutually exclusive and are intended to indicate that a particular feature, structure, or characteristic described in connection with the implementation may be included in at least one implementation. Such terms as used herein are not necessarily all referring to the same implementation. Any implementation may be combined with any other implementation, inclusively or exclusively, in any manner consistent with the aspects and implementations disclosed herein.

References to "or" may be construed as inclusive so that any terms described using "or" may indicate any of a single, more than one, and all of the described terms.

Where technical features in the drawings, detailed description, or any claim are followed by reference signs, the reference signs have been included for the sole purpose of increasing the intelligibility of the drawings, detailed description, and claims. Accordingly, neither the reference signs nor their absence have any limiting effect on the scope of any claim elements.

The systems and methods described herein may be embodied in other specific forms without departing from the characteristics thereof. Although the examples provided may be useful for providing games with multiple hand based side wagers, the systems and methods described herein may be applied to other environments. The foregoing implementations are illustrative, rather than limiting, of the described systems and methods. The scope of the systems and methods described herein may thus be indicated by the appended claims, rather than the foregoing description, and changes that come within the meaning and range of equivalency of the claims are embraced therein.

What is claimed is:

1. A gaming system comprising:

one or more processors coupled to memory, the one or more processors configured to:

provide, to a user device for presentation, a user interface including a plurality of respective first display regions for a plurality of hands for a play of a card game and a second display region for showing potential payouts for side wagers;

receive, from the user device, a plurality of base wagers for the play of the card game and a side wager, each base wager of the plurality of base wagers corresponding to a respective hand of a plurality of hands of the play of the card game, the side wager corresponding to a side wager condition;

provide, responsive to receiving the plurality of base wagers and the side wager, the plurality of hands for the play of the card game to the user device for display in the plurality of respective first display regions;

responsive to providing the plurality of hands and prior to receiving input from the user device to advance the play of the card game:

determine a number of the plurality of hands that satisfy the side wager condition;

provide a signal to the user device that causes the user interface to graphically highlight each respective first display region of the plurality of respective first display regions that correspond to each of the plurality of hands that satisfy the side wager condition;

select, from a paytable, an award parameter from a plurality of award parameters based on the determined number of the plurality of hands that satisfy the side wager condition, the plurality of award parameters including i) at least one first award parameter that corresponds to a predefined award modifier and ii) at least one second award parameter, which when selected, causes the one or more processors to randomly select a number corresponding to a random award modifier;

adjust a credit balance of an account associated with the user device by a first award amount calculated based on the selected award parameter and the side wager; and provide a signal to the user device that causes the user interface to graphically represent the selected award parameter in the second display region;

upon completion of the play of the card game, for each hand of the plurality of hands, determine a respective second award amount based on an outcome of the hand and a respective base wager of the hand; and adjust the credit balance of the account based on the respective second award amount for each of the plurality of hands.

2. The gaming system of claim 1, wherein the card game is blackjack, and wherein to provide the plurality of hands, the one or more processors are further configured to provide two initial cards for each hand of the plurality of hands.

3. The gaming system of claim 2, wherein to determine the number of the plurality of hands that that satisfy the side wager condition, the one or more processors are further configured to compare a total value of each of the plurality of hands to the side wager condition.

4. The gaming system of claim 1, wherein the card game is poker, and wherein to provide the plurality of hands, the one or more processors are further configured to provide a predetermined number of initial cards for each hand of the plurality of hands.

5. The gaming system of claim 4, wherein the side wager condition is a predetermined poker rank, and wherein to determine the number of the plurality of hands that that satisfy the side wager condition, the one or more processors are further configured to compare a respective poker rank of each of the plurality of hands to the predetermined poker rank.

6. The gaming system of claim 1, wherein the one or more processors are further configured to resolve the play of the card game for each of the plurality of hands according to rules of the play of the card game.

7. The gaming system of claim 6, wherein to resolve the play of the card game, the one or more processors are further configured to:

receive a selection for a turn of the play of the card game for each of the plurality of hands; and resolve the play of the card game according to the selection for the turn for each of the plurality of hands.

8. The gaming system of claim 1, wherein to receive the plurality of base wagers and the side wager, the one or more processors are further configured to:

provide, to a client device, a second user interface via which a player can place the plurality of base wagers and select to participate in the side wager corresponding to the side wager condition; and receive the plurality of base wagers and the side wager via the second user interface to the client device.

9. The gaming system of claim 1, wherein the at least one first award parameter is 4, 20, or 420, and wherein the number randomly selected is one of 1, 2, or 3.

10. The gaming system of claim 1, wherein the side wager condition is satisfied if a sum of a value of each card of the hand is equal to 20.

11. A method, comprising:

providing, to a user device for presentation, a user interface including a plurality of respective first display regions for a plurality of hands for a play of a card game and a second display region for showing potential payouts for side wagers;

receiving, by one or more processors coupled to memory, from the user device, a plurality of base wagers for the play of the card game and a side wager, each base wager of the plurality of base wagers corresponding to a respective hand of a plurality of hands of the play of the card game, the side wager corresponding to a side wager condition;

providing, by the one or more processors, responsive to receiving the plurality of base wagers and the side wager, the plurality of hands for the play of the card game to the user device for display in the plurality of respective first display regions;

responsive to providing the plurality of hands and prior to receiving input from the user device to advance the play of the card game:

determining, by the one or more processors, a number of the plurality of hands that satisfy the side wager condition;

providing, by the one or more processors, a signal to the user device that causes the user interface to graphically highlight each respective first display region of the plurality of respective first display regions that correspond to each of the plurality of hands that satisfy the side wager condition;

selecting, by the one or more processors, from a paytable, an award parameter from a plurality of award parameters based on the determined number of the plurality of hands that satisfy the side wager condition, the plurality of award parameters including i) at least one first award parameter that corresponds to a predefined award modifier and ii) at least one second award parameter, which when selected, causes the one or more processors to randomly select a number corresponding to a random award modifier;

adjusting, by the one or more processors, a credit balance of an account associated with the user device by a first award amount calculated based on the selected award parameter and the side wager; and providing, by the one or more processors, a signal to the user device that causes the user interface to graphically represent the selected award parameter in the second display region:

upon completion of the play of the card game, determining, by the one or more processors, for each hand of the plurality of hands, a respective award amount based on an outcome of the hand and a respective base wager of the hand; and adjusting, by the one or more processors, the credit balance of the account based on the respective second award amount for each of the plurality of hands.

12. The method of claim 11, wherein the card game is blackjack, and wherein providing the plurality of hands further comprises providing, by the one or more processors, two initial cards for each hand of the plurality of hands.

13. The method of claim 12, wherein determining the number of the plurality of hands that satisfy the side wager condition further comprises comparing, by the one or more processors, a total value of each of the plurality of hands to the side wager condition.

14. The method of claim 11, wherein the card game is poker, and wherein providing the plurality of hands further comprises providing, by the one or more processors, a predetermined number of initial cards for each hand of the plurality of hands.

15. The method of claim 14, wherein the side wager condition is a predetermined poker rank, and wherein determining the number of the plurality of hands that that satisfy the side wager condition further comprises comparing, by the one or more processors, a respective poker rank of each of the plurality of hands to the predetermined poker rank.

16. The method of claim 11, further comprising resolving, by the one or more processors, the play of the card game for each of the plurality of hands according to rules of the play of the card game.

17. The method of claim 16, wherein resolving the play of the card game further comprises:

receiving, by the one or more processors, a selection for a turn of the play of the card game for each of the plurality of hands; and resolving, by the one or more processors, the play of the card game according to the selection for the turn for each of the plurality of hands.

18. The method of claim 11, wherein the at least one first award parameter is 4, 20, or 420, and wherein the number randomly selected is one of 1, 2, or 3.

19. The method of claim 11, wherein the side wager condition is satisfied if a sum of a value of each card of the hand is equal to 20.

20. A gaming system comprising:

one or more processors coupled to memory, the one or more processors configured to:

provide, to a user device for presentation, a user interface including a plurality of respective first display regions for a plurality of hands for a play of a card game and a second display region for showing potential payouts for side wagers;

receive, from the user device, a plurality of base wagers for the play of the card game and a side wager, each base wager of the plurality of base wagers corresponding to a respective hand of a plurality of hands of the play of the card game, the side wager corresponding to a side wager condition;

provide, responsive to receiving the plurality of base wagers and the side wager, the plurality of hands for the play of the card game to the user device for display in the plurality of respective first display regions;

responsive to providing the plurality of hands and prior to receiving input from the user device to advance the play of the card game;

determine that cards of the plurality of hands that satisfy a side wager condition of a plurality of side wager conditions;

provide a signal to the user device that causes the user interface to graphically highlight each respective first display region of the plurality of respective first display regions that correspond to the cards that satisfy the side wager condition;

select, from a paytable, an award parameter from a plurality of award parameters based on an arrangement of the determined cards that satisfy the side wager condition, the plurality of award parameters including i) at least one first award parameter that corresponds to a predefined award modifier and ii) at least one second award parameter, which when selected, causes the one or more processors to randomly select a number corresponding to a random award modifier;

adjust a credit balance of an account associated with the user device by a first award amount calculated based on the selected award parameter and the side wager; and provide a signal to the user device that causes the user interface to graphically represent the award parameter in the second display region;

upon completion of the play of the card game, for each hand of the plurality of hands, determine a respective second award amount based on an outcome of the hand and a respective base wager of the hand; and adjust the credit balance of the account of based on the respective second award amount for each of the plurality of hands.

* * * * *